US012800173B2

(12) United States Patent
Murugesan et al.

(10) Patent No.: US 12,800,173 B2
(45) Date of Patent: Nov. 17, 2026

(54) BUILDING SYSTEM WITH MULTI-TIERED MODEL BASED OPTIMIZATION FOR VENTILATION AND SETPOINT CONTROL

(71) Applicant: Tyco Fire & Security GmbH, Neuhausen am Rheinfall (CH)

(72) Inventors: Sugumar Murugesan, Santa Clara, CA (US); Santle Camilus Kulandai Samy, Sunnyvale, CA (US); Young M. Lee, Old Westbury, NY (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 508 days.

(21) Appl. No.: 18/265,199

(22) PCT Filed: Dec. 3, 2021

(86) PCT No.: PCT/US2021/061788

§ 371 (c)(1),
(2) Date: Jun. 2, 2023

(87) PCT Pub. No.: WO2022/120158

PCT Pub. Date: Jun. 9, 2022

(65) Prior Publication Data

US 2024/0019158 A1 Jan. 18, 2024

Related U.S. Application Data

(60) Provisional application No. 63/121,583, filed on Dec. 4, 2020.

(51) Int. Cl.
*F24F 11/64* (2018.01)
*F24F 11/46* (2018.01)
(Continued)

(52) U.S. Cl.
CPC ..... *F24F 11/64* (2018.01); *F24F 11/46* (2018.01); *F24F 2110/50* (2018.01); *F24F 2140/60* (2018.01)

(58) Field of Classification Search
CPC .. F24F 11/46; F24F 11/47; F24F 11/52; F24F 11/64; G05B 13/048; G06Q 10/04; G06Q 10/06315; G06Q 50/06
(Continued)

(56) References Cited

U.S. PATENT DOCUMENTS 8,355,941 B2 * 1/2013 Lee ..... G06Q 10/04 705/7.11
10,936,764 B2 * 3/2021 Eckenrode ..... G06Q 10/06315
(Continued)

FOREIGN PATENT DOCUMENTS

CN 108287486 A * 7/2018 ..... G01R 11/56
WO WO-2020/145900 7/2020

OTHER PUBLICATIONS

International Search Report and Written Opinion on PCT Appl. No. PCT/US2021/061788 dated Mar. 9, 2022 (14 pages).

*Primary Examiner* — Crystal J Barnes-Bullock
(74) *Attorney, Agent, or Firm* — Foley & Lardner LLP

(57) ABSTRACT

A building system operates to receive building data for a building describing one or more conditions of the building and perform a first optimization with a multi-tiered model that predicts a first condition of the building based on a first control setting, the first optimization determining one or more first values of the first control setting. The building system operates to perform a second optimization with the multi-tiered model that predicts a second condition of the building based on a second control setting and the one or more first values of the first control setting, the second optimization determining one or more second values of the second control setting and operate building equipment based
(Continued)

on the one or more first values of the first control setting and the one or more second values of the second control setting.

20 Claims, 20 Drawing Sheets

(51) Int. Cl.
*F24F 110/50* (2018.01)
*F24F 140/60* (2018.01)

(58) Field of Classification Search
USPC ..... 700/276
See application file for complete search history.

(56) References Cited

U.S. PATENT DOCUMENTS

| | | | | |
|---|---|---|---|---|
| 11,519,631 | B2 * | 12/2022 | Fentzlaff | F24F 11/58 |
| 11,536,476 | B2 * | 12/2022 | Nesler | F24F 11/65 |
| 11,714,393 | B2 * | 8/2023 | Burroughs | F24F 11/52 700/2 |
| 12,007,732 | B2 * | 6/2024 | Risbeck | F24F 11/47 |
| 12,066,798 | B2 * | 8/2024 | Wan | F24F 11/46 |
| 2014/0365017 | A1 | 12/2014 | Hanna et al. | |
| 2020/0057827 | A1 | 2/2020 | Eckenrode et al. | |
| 2020/0356857 | A1 | 11/2020 | Lee et al. | |
| 2021/0063976 | A1 * | 3/2021 | Burroughs | G06Q 50/06 |
| 2022/0113688 | A1 * | 4/2022 | Wan | G05B 13/048 |
| 2022/0186962 | A1 * | 6/2022 | Turney | F24F 11/47 |
| 2022/0268471 | A1 * | 8/2022 | Turney | F24F 11/64 |

* cited by examiner

Occupancy and IAQ for continuous ventilation

Energy, Occupancy, OAT, and Setpoint for continuous ventilation

Occupancy and IAQ for staggered ventilation

Energy, Occupancy, OAT, and Setpoint for staggered ventilation

BUILDING SYSTEM WITH MULTI-TIERED MODEL BASED OPTIMIZATION FOR VENTILATION AND SETPOINT CONTROL

CROSS-REFERENCE TO RELATED PATENT APPLICATION

This application claims the benefit of and priority to U.S. Provisional Patent Application No. 63/121,583 filed December 4$^{th}$, 2020, the entirety of which is incorporated by reference herein.

BACKGROUND

The present disclosure relates to building systems of a building. The present disclosure relates more particularly to controlling environmental conditions of a building with the building systems.

A building system can include subsystems that control various environmental conditions of a building. For example, the subsystems can operate to heat or cool the building. The subsystems can be air handler units (AHUs), boilers, chillers, etc. Based on temperature and/or humidity setpoints, the building system can operate the subsystems to heat or cool the building based on the setpoints. Furthermore, the building can control indoor air quality (IAQ) of the building by controlling ventilation. However, controlling temperature and controlling IAQ may be separate operations performed separately in a building system.

SUMMARY

One implementation of the present disclosure is a building system including one or more memory devices storing instructions thereon that, when executed by one or more processors, cause the one or more processors to receive building data for a building describing one or more conditions of the building, perform a first optimization with a multi-tiered model that predicts a first condition of the building based on a first control setting, the first optimization determining one or more first values of the first control setting, perform a second optimization with the multi-tiered model that predicts a second condition of the building based on a second control setting and the one or more first values of the first control setting, the second optimization determining one or more second values of the second control setting, and operate building equipment based on the one or more first values of the first control setting and the one or more second values of the second control setting.

In some embodiments, the first condition of the building is indoor air quality (IAQ) of the building and the second condition is energy consumption of the building. In some embodiments, the first control setting includes ventilation actions and the second control setting includes temperature setpoint actions.

In some embodiments, the first condition is indoor air quality (IAQ) of the building and the second condition is carbon emissions associated with the building. In some embodiments, the first control setting includes ventilation actions and the second control setting includes temperature setpoint actions.

In some embodiments, the first optimization optimizes the first control setting without consideration of the second control setting.

In some embodiments, the first condition of the building and the second condition of the building are inversely proportional.

In some embodiments, the first optimization is performed before, and separate from, the second optimization to prioritize the first condition over the second condition.

In some embodiments, the first optimization is a first closed-loop optimization and the second optimization is a second closed-loop optimization.

In some embodiments, the multi-tiered model includes models including a first model and a second model. In some embodiments, the first model receives at least some of the building data and the first control setting as first inputs and predicts the first condition of the building based on the first inputs. In some embodiments, the first optimization determines the one or more first values of the first control setting that result in optimal predictions of the first condition of the building by the first model. In some embodiments, the second model receives at least some of the building data, the first control setting, and the second control setting as second inputs and predicts the second condition of the building based on the second inputs. In some embodiments, the second optimization determines the one or more second values of the second control setting that result in optimal predictions of the second condition of the building by the second model.

In some embodiments, the multi-tiered model includes models including a first model that predicts the first condition of the building and a second model that predicts the second condition of the building.

In some embodiments, the first model and the second model are sequence to sequence neural networks configured to receive a sequence of data inputs and predict a sequence of data outputs based on the sequence of data inputs, wherein the sequence of data inputs are the building data and the sequence of data outputs are one of the first control setting or the second control setting.

In some embodiments, the sequence to sequence neural networks are long-short term memory (LSTM) sequence to sequence neural networks.

In some embodiments, the first condition of the building is indoor air quality (IAQ) of the building and the second condition is energy consumption of the building. In some embodiments, the multi-tiered model includes an occupancy model configured to predict occupancy of the building, an indoor air quality (IAQ) model configured to predict the IAQ of the building based on the occupancy of the building predicted by the occupancy model and planned ventilations, and an energy model configured to predict the energy consumption of the building based on the occupancy of the building predicted by the occupancy model and the planned ventilations.

In some embodiments, the occupancy model receives at least one of a time of day, a day of week, a holiday schedule, or a meeting schedule and predicts the occupancy of the building based on at least one of the time of day, the day of week, the holiday schedule, or the meeting schedule.

In some embodiments, the energy model is configured to predict the energy consumption of the building based on the occupancy of the building predicted by the occupancy model, the planned ventilations, outdoor conditions of the building, and planned setpoint actions of the building.

Another implementation of the present disclosure is a method including receiving, by a processing circuit, building data for a building describing one or more conditions of the building, performing, by the processing circuit, a first optimization with a multi-tiered model that predicts a first condition of the building based on a first control setting, the first optimization determining one or more first values of the first control setting, performing, by the processing circuit, a second optimization with the multi-tiered model that predicts a second condition of the building based on a second control setting and the one or more first values of the first control setting, the second optimization determining one or more second values of the second control setting, and operating, by the processing circuit, building equipment based on the one or more first values of the first control setting and the one or more second values of the second control setting.

In some embodiments, the first condition of the building is indoor air quality (IAQ) of the building and the second condition is energy consumption of the building. In some embodiments, the first control setting includes ventilation actions and the second control setting includes temperature setpoint actions.

In some embodiments, the first optimization is performed before, and separate from, the second optimization to prioritize the first condition over the second condition.

In some embodiments, the multi-tiered model includes models including a first model that predicts the first condition of the building and a second model that predicts the second condition of the building. In some embodiments, the first model receives at least some of the building data and the first control setting as first inputs and predicts the first condition of the building based on the first inputs. In some embodiments, the first optimization determines the one or more first values of the first control setting that result in optimal predictions of the first condition of the building by the first model. In some embodiments, the second model receives at least some of the building data, the first control setting, and the second control setting as second inputs and predicts the second condition of the building based on the second inputs. In some embodiments, the second optimization determines the one or more second values of the second control setting that result in optimal predictions of the second condition of the building by the second model.

In some embodiments, the multi-tiered model includes an occupancy model configured to predict occupancy of the building, an indoor air quality (IAQ) model configured to predict IAQ of the building based on the occupancy of the building predicted by the occupancy model and planned ventilations, and an energy model configured to predict an energy consumption of the building based on the occupancy of the building predicted by the occupancy model and the planned ventilations.

Another implementation of the present disclosure is a building system including one or more memory devices storing instructions thereon that, when executed by one or more processors, cause the one or more processors to receive building data for a building describing one or more conditions of the building, determine one or more first values of a first control setting with a multi-tiered model that predicts a first condition of the building based on the first control setting, determine one or more second values of a second control setting with the multi-tiered model that predicts a second condition of the building based on the second control setting and the one or more first values of the first control setting, and operate building equipment based on the one or more first values of the first control setting and the one or more second values of the second control setting.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Overview

Figure 1:
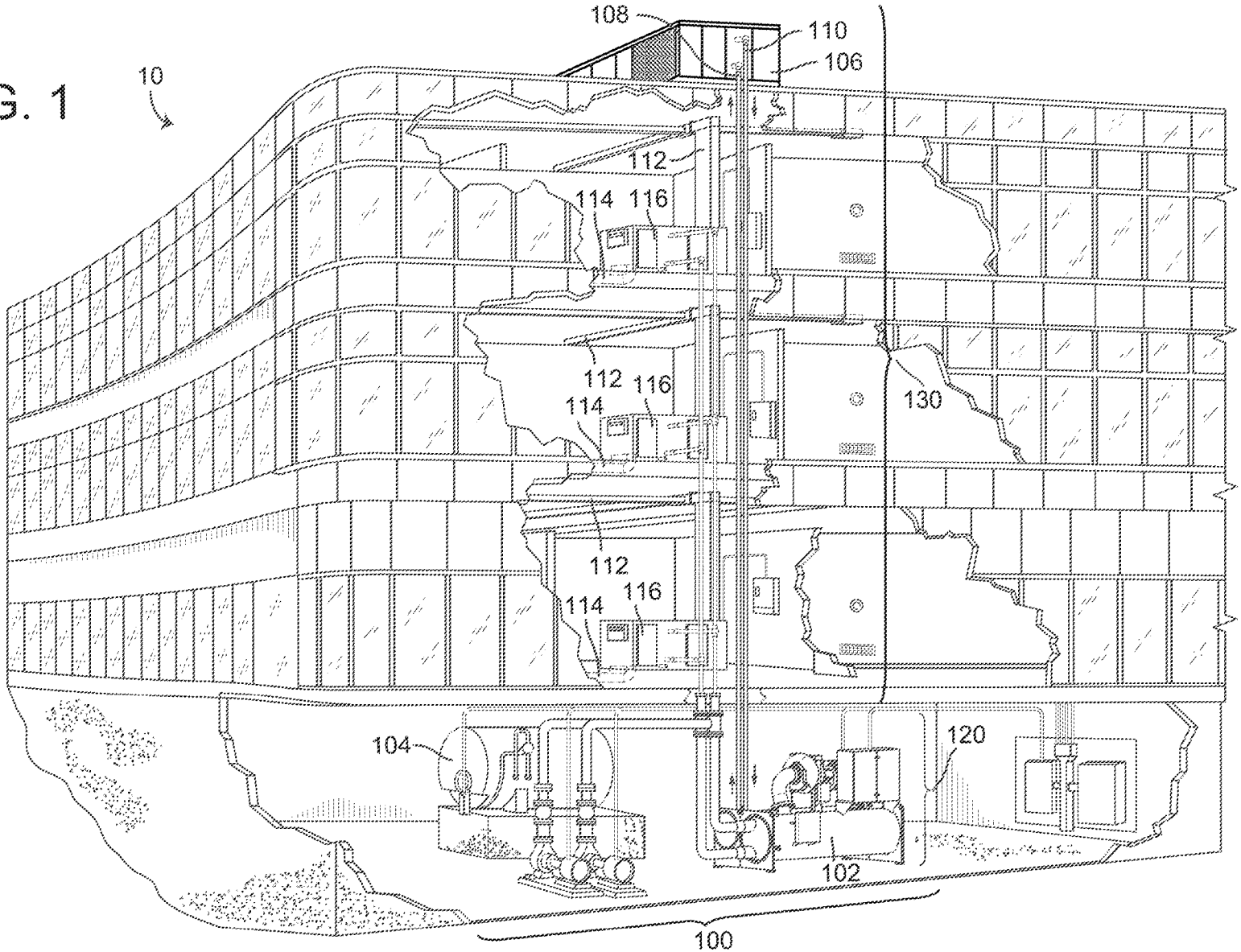
FIG. 1 is a schematic drawing of a building equipped with a HVAC system, according to an exemplary embodiment.

Referring generally to the FIGURES, systems and methods for a multi-tiered optimization for ventilation and setpoint control is shown, according to an exemplary embodiment. In some embodiments, a building system can increase workplace health when a disease is present in a population (e.g., COVID-19, SARS, the common cold, etc.) by improving IAQ. Furthermore, a building system can increase energy efficiency of a building by controlling how much energy the building uses to heat or cool the building. However, heating, ventilation, and air conditioning (HVAC) energy consumption may be inversely proportional to how much outdoor air is allowed into the building to improve IAQ (e.g., energy consumption and air quality may be inversely proportional). A tradeoff may exist between energy goals and the health goals of a building. For example, while ventilation may improve the air quality of the building, the ventilation could lead to energy inefficiency during the summer since ventilation may result in heat gain when the building system is trying to cool the building.

In some embodiments, the building system can implement an optimization to optimize energy consumption and IAQ. The building system can predict various building timeseries signals conditioned on various actions planned for the future. The building system can be configured to implement a multi-layered prediction and/or optimization to optimize energy usage and IAQ of the building. The building system can implement a multi-tiered approach to time-series prediction and optimization to resolve conflicting objectives, i.e., optimizing energy consumption and optimizing IAQ. The multi-tiered approach can reduce computing resources needed for optimization and reach an optimal or near-optimal solution with low computation complexity. This lower computing resource solution can allow for deployment on systems with lower memory and/or processing capabilities. For example, instead of requiring a server to perform the optimization, the low computing resource solution could be deployed directly on building controllers, AHU controllers, or other low computing power building devices.

Although IAQ and energy usage are often conflicting metrics as ventilation actions can result in energy loss, the multi-tiered approach can decouple these optimizations in a tiered fashion and ensure low computing complexity. Low computing complexity can enable the optimization to be deployed on-premises and allow for tuning ventilation and setpoint actions in real-time as the system learns new real-time information about building state. Some systems may attempt to solve the conflicting metric optimization problem in a brute-force fashion without decoupling air-quality and energy objectives. However, such an approach may need a large amount of computing resources and result in an inability to deploy the solution on the edge (on premise).

The building system performing the multi-tiered optimization for setpoint and ventilation decisions can improve a workplace for a disease scenario (e.g., when a disease such as COVID-19, SARS, etc. is present in a population) by optimizing both IAQ and energy. A disease such as COVID-19 can be expensive for a business. Therefore, the multi-tiered optimization may be used in situations when a disease is present. However, the multi-tiered optimization system can be deployed for various other reasons, e.g., to improve air quality, to improve energy consumption, etc.

Building Management System and HVAC System

Figure 2:
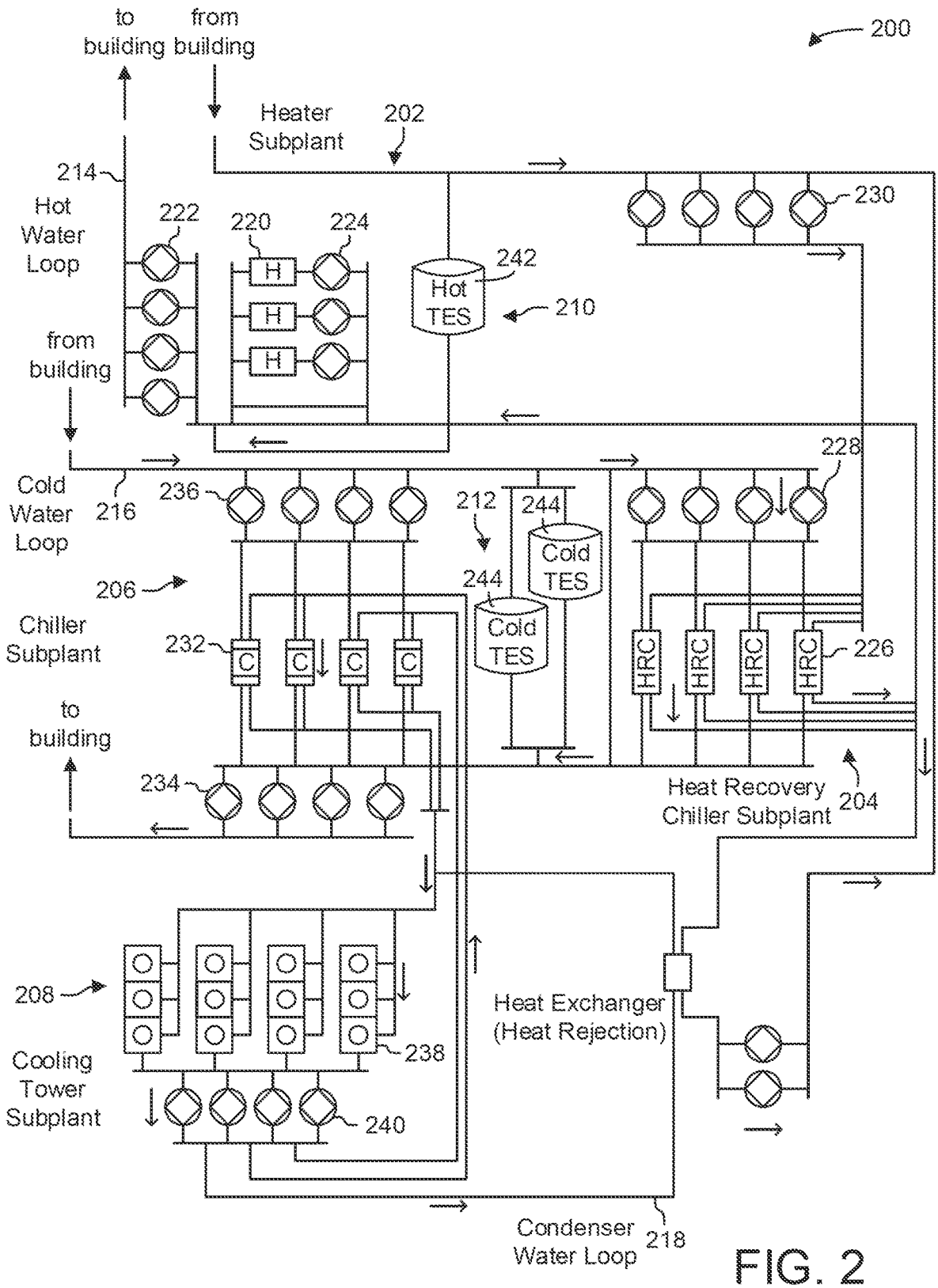
FIG. 2 is a block diagram of a waterside system that may be used in conjunction with the building of FIG. 1, according to an exemplary embodiment.
Figure 3:
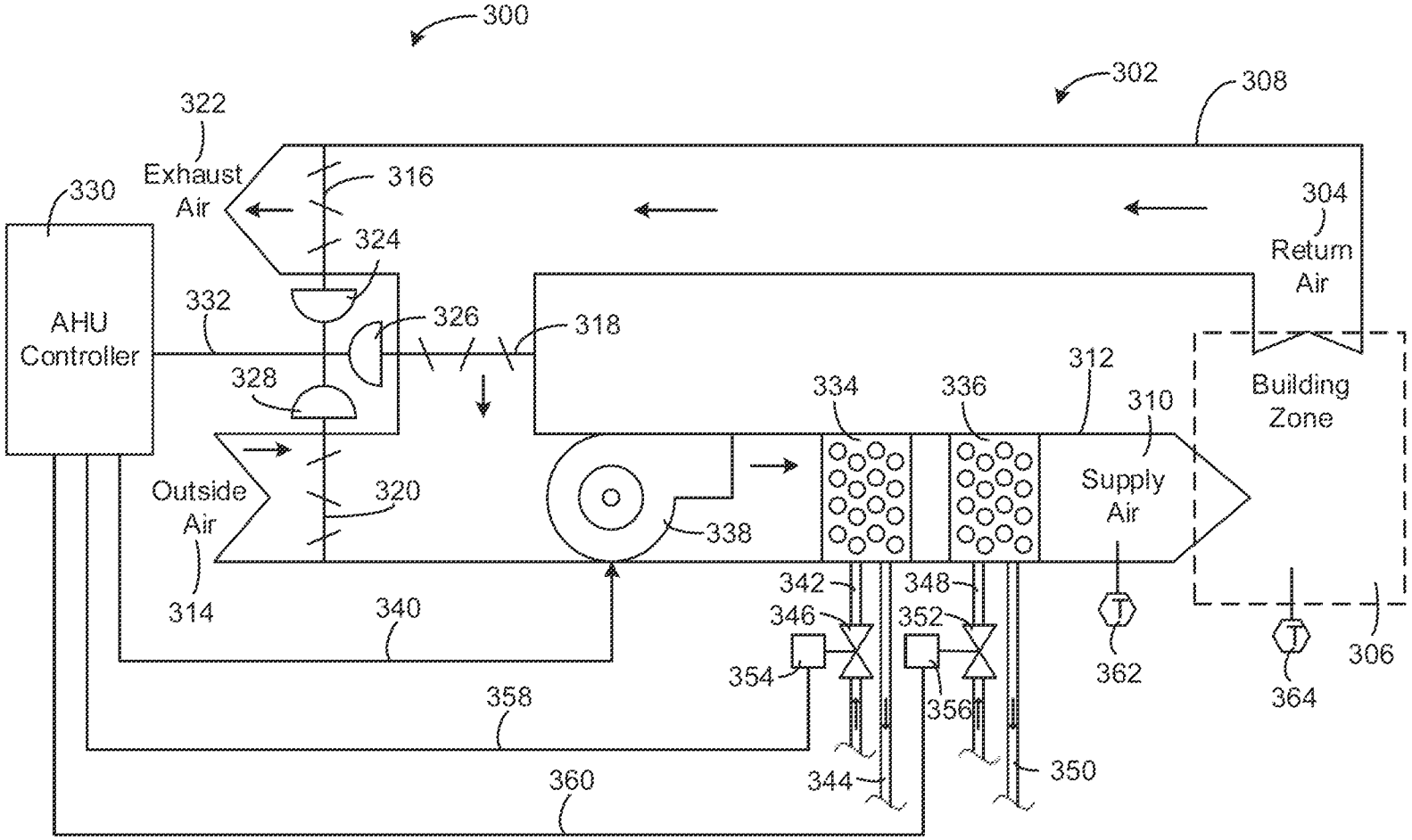
FIG. 3 is a block diagram of an airside system that may be used in conjunction with the building of FIG. 1, according to an exemplary embodiment.

Referring now to FIGS. 1-3, an exemplary building management system (BMS) and HVAC system in which the systems and methods of the present invention can be implemented are shown, according to an exemplary embodiment. Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes an HVAC system 100. HVAC system 100 can include HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10. An exemplary waterside system and airside system which can be used in HVAC system 100 are described in greater detail with reference to FIGS. 2-3.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve setpoint conditions for the building zone.

Referring now to FIG. 2, a block diagram of a waterside system 200 is shown, according to an exemplary embodiment. In various embodiments, waterside system 200 can supplement or replace waterside system 120 in HVAC system 100 or can be implemented separate from HVAC system 100. When implemented in HVAC system 100, waterside system 200 can include a subset of the HVAC devices in HVAC system 100 (e.g., boiler 104, chiller 102, pumps, valves, etc.) and can operate to supply a heated or chilled fluid to AHU 106. The HVAC devices of waterside system 200 can be located within building 10 (e.g., as components of waterside system 120) or at an offsite location such as a central plant.

In FIG. 2, waterside system 200 is shown as a central plant having a plurality of subplants 202-212. Subplants 202-212 are shown to include a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources (e.g., water, natural gas, electricity, etc.) from utilities to serve the thermal energy loads (e.g., hot water, cold water, heating, cooling, etc.) of a building or campus. For example, heater subplant 202 can be configured to heat water in a hot water loop 214 that circulates the hot water between heater subplant 202 and building 10. Chiller subplant 206 can be configured to chill water in a cold water loop 216 that circulates the cold water between chiller subplant 206 building 10. Heat recovery chiller subplant 204 can be configured to transfer heat from cold water loop 216 to hot water loop 214 to provide additional heating for the hot water and additional cooling for the cold water. Condenser water loop 218 can absorb heat from the cold water in chiller subplant 206 and reject the absorbed heat in cooling tower subplant 208 or transfer the absorbed heat to hot water loop 214. Hot TES subplant 210 and cold TES subplant 212 can store hot and cold thermal energy, respectively, for subsequent use.

Hot water loop 214 and cold water loop 216 can deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air can be delivered to individual zones of building 10 to serve the thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, CO2, etc.) can be used in place of or in addition to water to serve the thermal energy loads. In other embodiments, subplants 202-212 can provide heating and/or cooling directly to the building or campus without requiring an intermediate heat transfer fluid. These and other variations to waterside system 200 are within the teachings of the present invention.

Each of subplants 202-212 can include a variety of equipment configured to facilitate the functions of the subplant. For example, heater subplant 202 is shown to include a plurality of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a plurality of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a plurality of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a plurality of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 can also include one or more pumps or valves configured to control the flow rate of the hot water into or out of hot TES tank 242. Cold TES subplant 212 is shown to include cold TES tanks 244 configured to store the cold water for later use. Cold TES subplant 212 can also include one or more pumps or valves configured to control the flow rate of the cold water into or out of cold TES tanks 244.

In some embodiments, one or more of the pumps in waterside system 200 (e.g., pumps 222, 224, 228, 230, 234, 236, and/or 240) or pipelines in waterside system 200 include an isolation valve associated therewith. Isolation valves can be integrated with the pumps or positioned upstream or downstream of the pumps to control the fluid flows in waterside system 200. In various embodiments, waterside system 200 can include more, fewer, or different types of devices and/or subplants based on the particular configuration of waterside system 200 and the types of loads served by waterside system 200.

Referring now to FIG. 3, a block diagram of an airside system 300 is shown, according to an exemplary embodiment. In various embodiments, airside system 300 can supplement or replace airside system 130 in HVAC system 100 or can be implemented separate from HVAC system 100. When implemented in HVAC system 100, airside system 300 can include a subset of the HVAC devices in HVAC system 100 (e.g., AHU 106, VAV units 116, ducts 112-114, fans, dampers, etc.) and can be located in or around building 10. Airside system 300 can operate to heat or cool an airflow provided to building using a heated or chilled fluid provided by waterside system 200.

In FIG. 3, airside system 300 is shown to include an economizer-type air handling unit (AHU) 302. Economizer-type AHUs vary the amount of outside air and return air used by the air handling unit for heating or cooling. For example, AHU 302 can receive return air 304 from building zone 306 via return air duct 308 and can deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 can be configured to operate exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 can communicate with an AHU controller 330 via a communications link 332. Actuators 324-328 can receive control signals from AHU controller 330 and can provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 can communicate with fan 338 via communications link 340 to control a flow rate of supply air 310. In some embodiments, AHU controller 330 controls an amount of heating or cooling applied to supply air 310 by modulating a speed of fan 338.

Cooling coil 334 can receive a chilled fluid from waterside system 200 (e.g., from cold water loop 216) via piping 342 and can return the chilled fluid to waterside system 200 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330) to modulate an amount of cooling applied to supply air 310.

Heating coil 336 can receive a heated fluid from waterside system 200(e.g., from hot water loop 214) via piping 348 and can return the heated fluid to waterside system 200 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 can communicate with AHU controller 330 via communications links 358-360. Actuators 354-356 can receive control signals from AHU controller 330 and can provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 can also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a setpoint temperature for supply air 310 or to maintain the temperature of supply air 310 within a setpoint temperature range). The positions of valves 346 and 352 affect the amount of heating or cooling provided to supply air 310 by cooling coil 334 or heating coil 336 and may correlate with the amount of energy consumed to achieve a desired supply air temperature. AHU controller 330 can control the temperature of supply air 310 and/or building zone 306 by activating or deactivating coils 334-336, adjusting a speed of fan 338, or a combination of both.

Neural Networks

Figure 4:
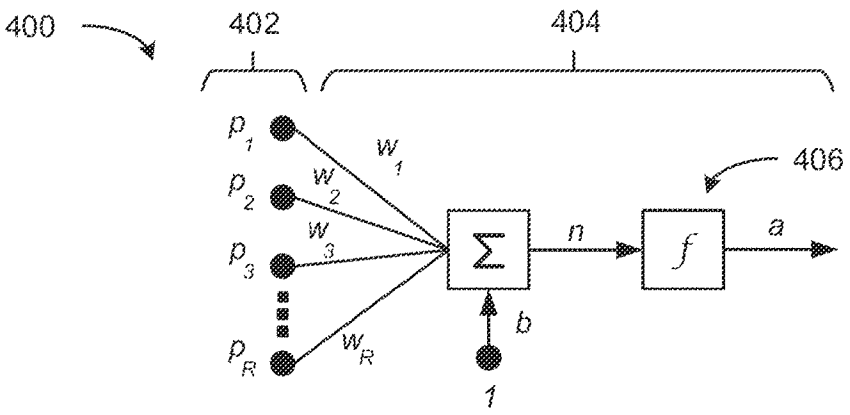
FIG. 4 is a block diagram of a neuron of a neural network, according to an exemplary embodiment.

Referring now to FIG. 4, a neuron 400 that can be used in a neural network is shown, according to an exemplary embodiment. In a neural network, many neurons 400 can be used to generate an output from an input. The neuron 400 can be configured to include one or more input signals 402 and a neuron body 404. In some embodiments, the input signals 402 are provided by a particular data source. In other embodiments, the input signals 402 are provided by a previous neural network layer having one or more neurons 400. The neuron body 404 includes a series of weights assigned to each of the input signals 402 by which each input signal is multiplied in the neural network. The neuron body 404 also includes a summation operation which takes the product all input signals 402 and their associated weights and add them together. Furthermore, a single bias value, b, is assigned to each neuron 400 and added to the sum of all weighted input signals 402. The weights and bias values can vary between the neurons 400 used in a neural network. In some embodiments, the summation operation is defined as follows:

$$n = b + \sum_{x=1}^{R} (p_x \times w_x)$$

The output of the summation operation and bias value is denoted as n in FIG. 4. The output, n, may then be provided as input to an activation function 406. The activation function 406 is a function applied to n for each neuron 400 in order to adjust the neuron activation level into some that range of values. In some embodiments, the activation function 406 is applied to the output, n, to transform the output into some real number between zero and one. In some embodiments, the activation function 406 is configured as a sigmoid function having the following form:

$$a = \frac{1}{1 + e^x}$$

In another embodiment, the activation function 406 could be configured as a rectified linear unit function (ReLU) having the following form:

$$a = \max(0, x)$$

In other embodiments, the activation function 406 could be some other linear or nonlinear function. The activation function 406 can be configured to create an activation level, a, within the desired range of real numbers. In some embodiments, the activation level of each neuron 400 is then provided as an input signal 402 to the neurons 400 of the next layer of the convolutional neural network. In some embodiments, the activation function 406 can be a tanh activation.

Figure 5:
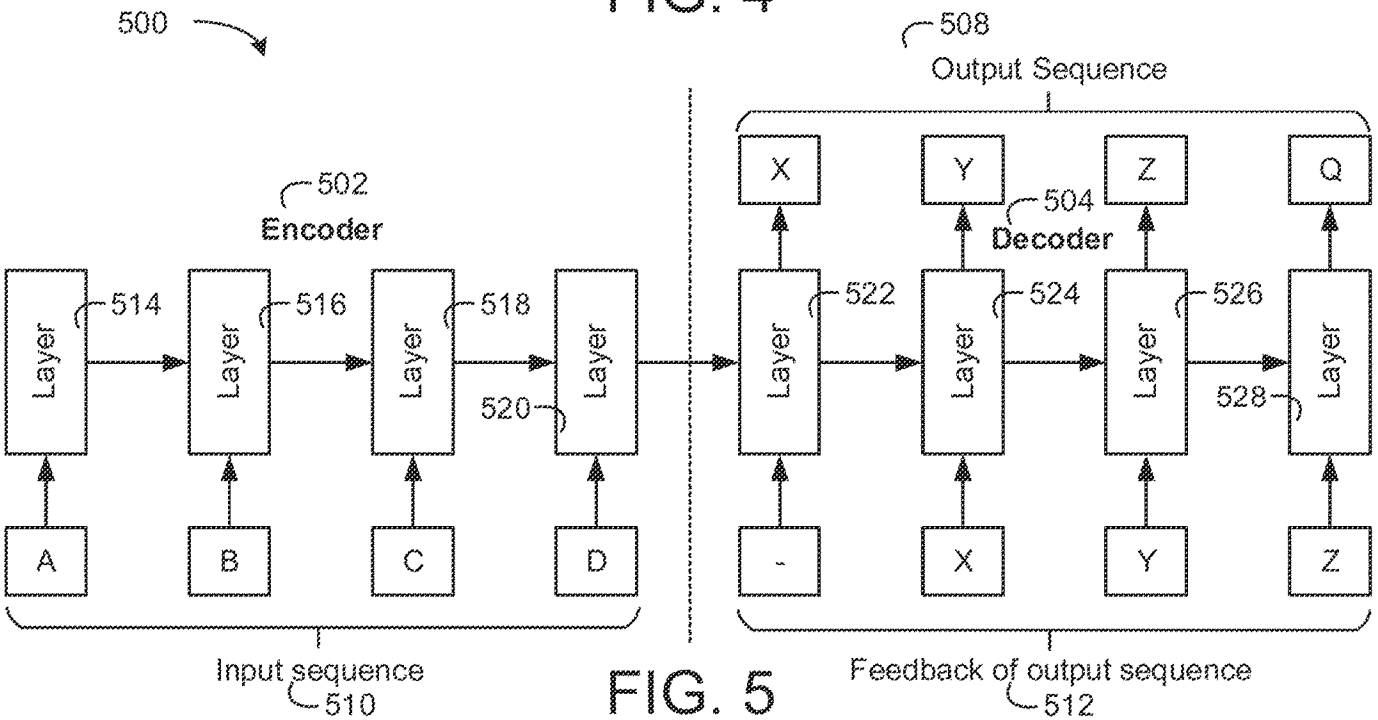
FIG. 5 is a block diagram of a long-short term memory sequence to sequence (LSTM S2S) neural network, according to an exemplary embodiment.

Referring now to FIG. 5, a LSTM S2S neural network 500 is shown, according to an exemplary embodiment. An LSTM is a type of RNN while S2S is an architectural form of neural network. The LSTM S2S neural network 500 is made of two main components, an encoder 502 and a decoder 504. The encoder 502 can receive an input sequence of a data point in the past, i.e., sequence 510. The decoder 504 can generate a sequence in the future for the data point. Furthermore, the decoder can receive feedback input sequence 512 into the decoder 504 where the sequence 412 is at least a portion of the sequence 508.

The encoder 502 can be configured to transform a sequence into a vector which is passed to the decoder 504. More specifically, the encoder 502 can be configured to generate the vector based on the sequence 510. The decoder 504 can be configured to generate a sequence based on the vector of the encoder 502 (as well as other inputs). Both the encoder 502 and the decoder 504 can include multiple layers, i.e., layers 514-528. Each of the layers 414-428 can be LSTM layers and/or deep LSTM layers. Exemplary types of RNN layers are described with reference to FIGS. 6-7. Other types of layers may be GRU neural network layers.

The sequences 508, 510, and 512 can represent historical values of a data point (the sequence 510), predicted values of the data point for one or multiple times in the future (the sequence 508), and the predicted values of the data point fed back into the decoder 504 (the sequence 512). As illustrated by FIG. 5, the input to layer 524 is the value "X" of the sequence 512 which is the output of the layer 522. Similarly, the output of the layer 524, "Y," is the input to the layer 526. Furthermore, the output of the layer 526, "Z," is the input of the layer 528. The data point can be a control point, an ambient condition data point (e.g., outdoor air temperature, humidity, air quality, etc.), energy usage of a campus or building, etc.

Figure 6:
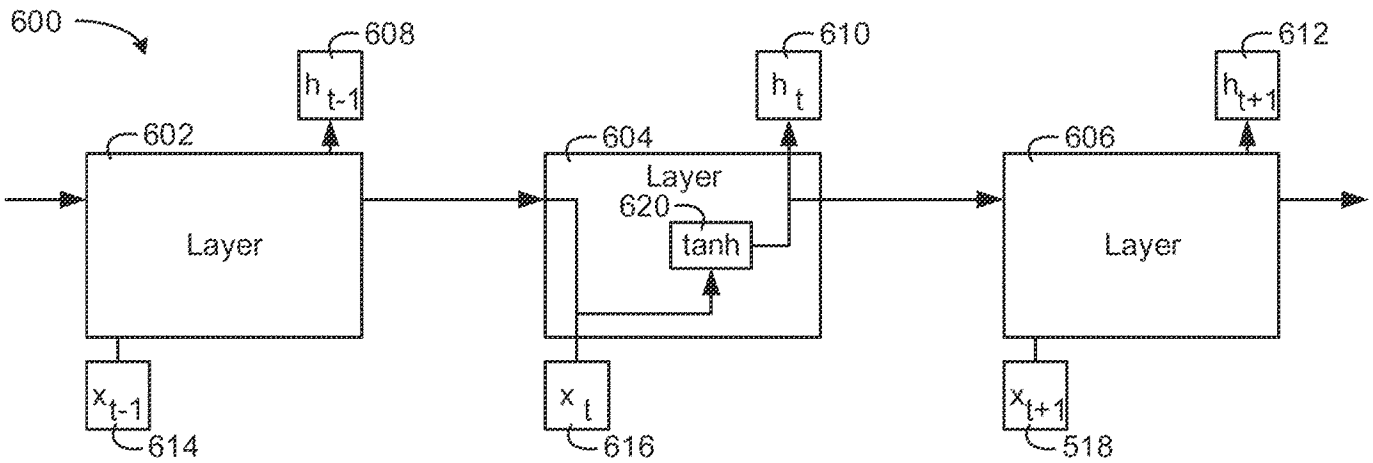
FIG. 6 is a block diagram of layers of a recurrent neural network (RNN), according to an exemplary embodiment.

Referring now to FIG. 6, layers of a RNN 600 are shown, according to an exemplary embodiment. The RNN 600 includes layers 602-606. The architecture of each of the layers 602-606 may be the same. The architecture is illustrated by the layer 604. Each of the layers 602-606 may receive an input, i.e., inputs 614-618 while each of the layers 602-606 can also generate an output 608-612. Each of the layers 602-606 may be chained together such that the output of each layer is fed into the next layer. In layer 604, the output of the layer 602 (the output 608) is fed into the layer 604 and is concatenated with the input 616. The result of the concatenation is passed through a tanh activation 620 which is subsequently passed out of the layer 604 to the layer 606, i.e., the output 610.

The architecture of the layers 602-606 allow for the RNN 600 to have memory, i.e., have persistence of outputs. However, while the RNN 600 may include memory, the memory may not be long term, i.e., the RNN 600 suffers from the vanishing gradient problem and encounters difficulty in learning long term. To address the effects of long term memory, an LSTM can be utilized.

Figure 7:
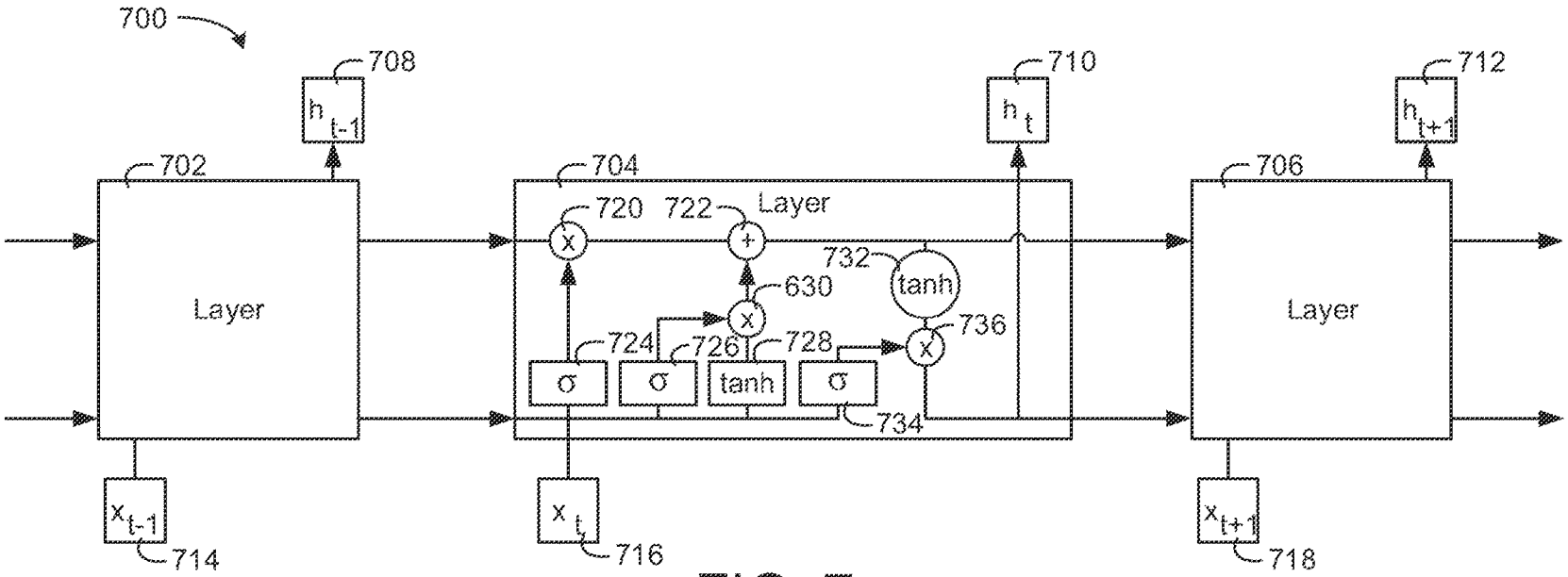
FIG. 7 is a block diagram of layers of a LSTM neural network, according to an exemplary embodiment.

Referring now to FIG. 7, a LSTM neural network 700 is shown, according to an exemplary embodiment. The LSTM neural network 700 includes layers 702-706. The architecture of each of the layers 702-706 may be the same. The architecture is illustrated by the layer 704. Each of the layers 702-706 may receive an input, i.e., inputs 714-718 while each of the layers 702-706 can also generate an output 708-712. Each of the layers 702-706 may be chained together such that the outputs of each layer is fed into the next layer. The layer 704 can include neural network layers 724, 726, 728, and 734 which are shown as tanh and sigmoid activations respectively. Furthermore, the layer 704 includes pointwise operations 720, 722, 730, 732, and 736 which represent multiplication, addition, and tanh variously. Where multiple lines between layers come together in the layer 704 represents concatenation. Greater details on RNN and LSTM networks and layer construction can be found in the publication "Understanding LSTM Networks" by Christopher Olah published on August 27 th, 2015, the entirety of which is incorporated by reference herein.

Multi-Tiered Optimization

Figure 8:
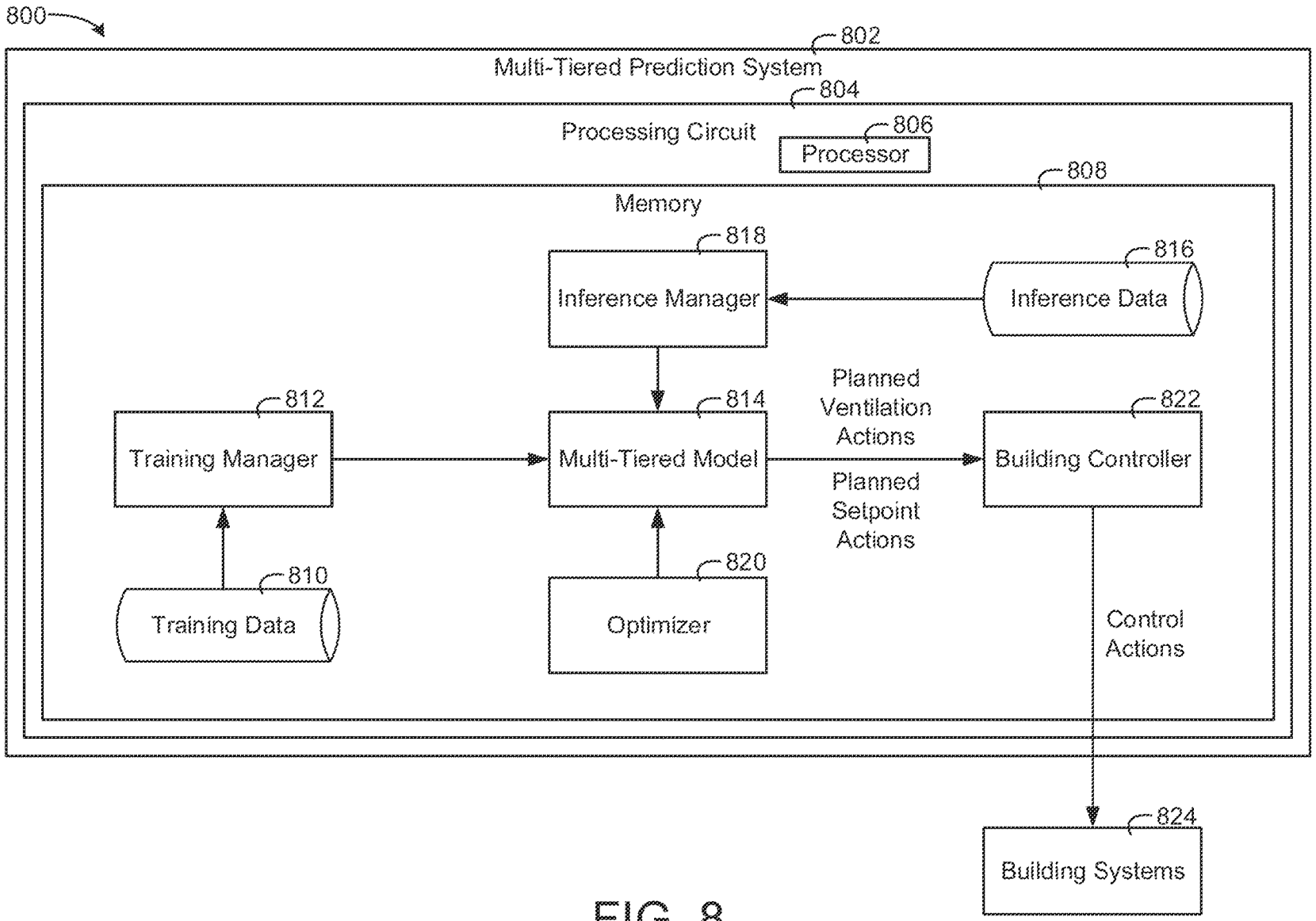
FIG. 8 is a block diagram of a multi-tiered prediction system for predicting setpoints and ventilation actions based on a multi-tiered model, according to an exemplary embodiment.

Referring now to FIG. 8, a system 800 including a multi-tiered prediction system 802 for predicting setpoints and ventilation actions based on a multi-tiered model 814 is shown, according to an exemplary embodiment. The system 800 includes the multi-tiered prediction system 802 and building systems 824. The building systems 824 can be systems that control ventilation and/or temperature of a building, e.g., the building 10. The building systems 824 can be the building systems described with reference to FIGS. 1-3. The building systems 824 can operate to ventilate the building 10 based on one or more ventilation decisions made by the multi-tiered prediction system 802 to ventilate the building 10 at one or more times. Furthermore, the building systems 824 can operate to heat or cool the building to one or more temperature setpoints at one or more times.

The multi-tiered prediction system 802 includes a processing circuit 804. The processing circuit 804 includes a processor 806 and a memory 808. In some embodiments, the multi-tiered prediction system 802 includes one or more processing circuits, one or more processors, and/or one or more memory devices. The processor 806 can be a general purpose or specific purpose processor, an application specific integrated circuit (ASIC), one or more field programmable gate arrays (FPGAs), a group of processing components, or other suitable processing components. The processor 806 may be configured to execute computer code and/or instructions stored in the memory 808 or received from other computer readable media (e.g., CDROM, network storage, a remote server, etc.).

The memory 808 can include one or more devices (e.g., memory units, memory devices, storage devices, etc.) for storing data and/or computer code for completing and/or facilitating the various processes described in the present disclosure. The memory 808 can include random access memory (RAM), read-only memory (ROM), hard drive storage, temporary storage, non-volatile memory, flash memory, optical memory, or any other suitable memory for storing software objects and/or computer instructions. The memory 808 can include database components, object code components, script components, or any other type of information structure for supporting the various activities and information structures described in the present disclosure. The memory 808 can be communicably connected to the processor 806 and can include computer code for executing (e.g., by the processor 806) one or more processes described herein.

The multi-tiered prediction system 802 is configured to perform a multi-tiered approach to time-series prediction and optimization of conflicting objectives, in some embodiments. The multi-tiered prediction system 802 can predict time-series data with the multi-tiered model 814 and perform one or more optimizations to determine planned ventilation actions and/or planned setpoint actions, in some embodiments. In some embodiments, the multi-tiered prediction system 802 is configured to prioritize ventilation as an independent optimization formulation to ensure that the building 10 will have significant ventilation, e.g., a ventilation level recommended by a health service (e.g., the CDC) to avoid the spread of a disease. Furthermore, the multi-tiered prediction system 802 can determine setpoints that reduce total building energy consumption of the building 10 while providing a comfortable building.

In some embodiments, the multi-tiered prediction system 802 can perform multiple tiered predictions, e.g., a first optimization to determine optimal ventilation actions that result in ideal IAQ and a second optimization following the first optimization to determine setpoints that result in low energy consumption by the building and comfortable environmental conditions of the building. The hierarchical optimization can reduce the computing complexity of a multi-parameter optimization. The low computational computing complexity solution may be used for real-time optimizations and/or edge based solutions (e.g., where the multi-tiered prediction system 802 is a local controller or thermostat of a building). In some embodiments, the multi-tiered prediction system 802 applies one or more decision rules instead of, or in addition to, performing an optimization. In this regard, the multi-tiered prediction system 802 can perform a non-optimization based multi-tiered decision process.

While the components of the system 802 are all shown within a single device, in some embodiments, the components can be spread across multiple devices and/or computing systems. The memory 808 includes a training manager 812, the multi-tiered model 814, an inference manager 818, an optimizer 820, and a building controller 822. The memory 808 further includes data storage, e.g., the training data 810 and the inference data 816. The multi-tiered model 814 can include one or more models for predicting parameters. For example, the multi-tiered model 814 can be configured to predict occupancy, IAQ, and/or an energy-comfort cost. In some embodiments, the multi-tiered model 814 includes multiple different models that may be interconnected. For example, the multi-tiered model 814 can include a model for predicting occupancy based on time of day, day of week, a holiday schedule, and/or a meeting schedule. The multi-tiered model 814 can include a model that predicts indoor air quality based on occupancy and/or a planned ventilation. The multi-tiered model 814 can include a model the predicts energy comfort cost based on planned ventilations, outdoor conditions, and/or planned setpoint actions.

The training manager 812 can be configured to train the multi-tiered model 814 based on the training data. The training data can include data for training each of the models of the multi-tiered model 814 individually and/or together. The training data 810 can include a time of day, a day of week, a holiday schedule, a meeting schedule, planned ventilations, outdoor conditions, and/or planned setpoint actions. In some embodiments, the models of the multi-tiered model 814 are neural networks, e.g., sequence to sequence neural networks that predict timeseries data. For example, the neural networks can make timeseries output predictions based on input timeseries data. In some embodiments, the neural networks are long-short term memory (LSTM) neural networks, and/or any other neural network. Examples of neural networks that the multi-tiered model 814 can include can be the same as, or similar to, the neural networks described with reference to FIGS. 4-7. In some embodiments, the multi-tiered model 814 is a model or a group of models such as Bayesian networks, decision trees, support vector machines, regression analysis, genetic algorithms, etc.

The training manager 812 can be configured to train the multi-tiered model 814 based on the training data 810. The training manager 812 can perform, training, validation, and/or testing of the multi-tiered model 814. The training manager 812 can be configured to fit one or more parameters and/or weights of the multi-tiered model 814. The training manager 812 can be configured to perform training algorithms such as gradient descent, the Newton method, conjugate gradient, the Quasi-Newton method, and/or the Levenberg-Marquardt algorithm.

For a new building or a legacy building where no history of IAQ and/or energy consumption data is available, the training manager 812 can use a model of the building 10 (e.g., an EnergyPlus model) to simulate the training data 810 for building prediction models which can later be trained with real building data. Examples of simulating training data for a building when no building data is available is described in U.S. patent application Ser. No. 16/398,535 filed April +30 $^{th}$, 2019, which is incorporated by reference herein.

The multi-tiered model 814 can be configured to predict information, e.g., predict an occupancy timeseries, an IAQ timeseries, and/or predict an energy-comfort cost timeseries. An inference manager 818 can apply inference data 816 to the multi-tiered model 814 to predict information. The inference data 816 can be the same as the training data 810 but collected for a particular time period, e.g., for prediction on a particular day, week, month, and/or year.

The optimizer 820 can be configured to perform an optimization based on outputs and/or inputs into the models of the multi-tiered model 814 to determine optimal planned ventilation actions and/or optimal planned setpoint actions. The actions may be a timeseries of actions, e.g., a timeseries of ventilation actions and/or a timeseries of setpoints. The optimizer 820 can be configured to perform one or more closed-loop optimizations and/or one or more non-optimization based determinations. The optimizer 820 can perform any type of optimization algorithm, e.g., a simplex algorithm, a quadratic programming optimization, and/or linear fractional algorithm, combinatorial algorithm, quantum optimization algorithm, Newton's method, Quasi-Newton method, etc.

The building controller 822 can be configured to control the building system 824 based on the planned ventilation actions and/or the planned setpoint actions. The building controller 822 can control the building systems 824 based on a schedule of control decisions, e.g., a timeseries of planned ventilation actions and/or a timeseries of planned setpoint values. The building controller 822 can generate control signals and/or communicate the planned ventilation actions and/or planned setpoint actions to the building systems 824. In some embodiments, the building controller 822 performs a control algorithm with the planned ventilation actions and/or the planned setpoint actions, e.g., a proportional (P) control algorithm, a proportional-integral (PI) control algorithm, and/or a proportional-integral-derivative (PID) control algorithm. In some embodiments, the building controller 822 can perform hysteresis control, fuzzy control, model predictive control (MPC), and/or any other type of control algorithm.

Figure 9:
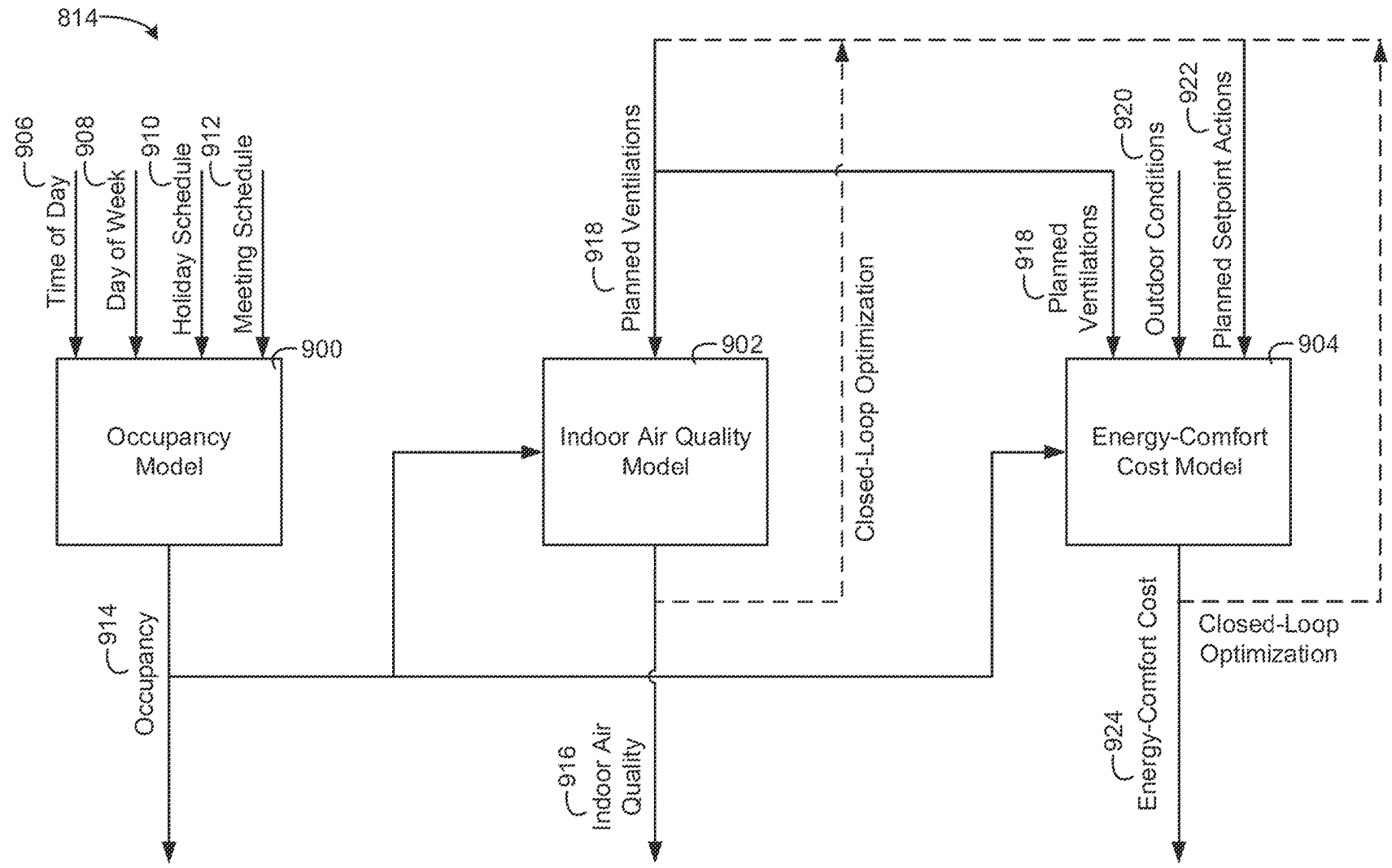
FIG. 9 is a block diagram of the multi-tiered model, according to an exemplary embodiment.

Referring now to FIG. 9, is a block diagram of the multi-tiered model 814 is shown, according to an exemplary embodiment. In the presence of a spreading disease, health and safety (e.g., a probability of catching the disease from an infected individual within the building) in the building 10 can be improved by improving IAQ. To control the infection spread, ventilation in the building 10 based on indoor environmental conditions and ongoing community transmission in the area of the building 10 can be improved. Indoor environmental conditions of the building 10 may be a function of IAQ and thermal characteristics such as temperature and humidity.

In an energy efficient building, HVAC energy consumption is inversely proportional to how much outdoor air is allowed into the building to improve ventilation. To solve this tradeoff, time series predictions of various building states such as energy and IAQ can be utilized. The multi-tiered model 814 can predict various building time-series data such as occupancy, IAQ, and energy-comfort cost in a layered fashion, through multiple models 900-904, through which several building operational decisions can be made. The multi-tiered model 814 can provide a trade-off between energy efficiency with those that prioritize occupant health and well-being (e.g., IAQ).

The multi-tiered model 814 includes an occupancy model 900, an indoor air quality model 902, and an energy-comfort cost model 904. The occupancy model 900 can receive timeseries data and predict an occupancy timeseries, the occupancy 914. The input into the occupancy model 900 can be a time of day 906, a day of week 908, a holiday schedule 910, and/or a meeting schedule 912. The occupancy 914 predicted by the occupancy model 900 can be fed into an indoor air quality model 902 and an energy-comfort cost model 904.

The indoor air quality model 902 can receive the occupancy 914 and planned ventilations 918 as inputs. The planned ventilations 918 may be a timeseries of ventilation actions for a day, week, or month of the building 10, e.g., ventilations at particular times(at a particular second, minute, and/or hour). The indoor air quality model 902 can predict the indoor air quality 916 based on the occupancy 914 and the planned ventilations 918. The indoor air quality 916 can be a timeseries of predicted IAQ values for particular minutes, hours, days, months, etc. of a time period.

The optimizer 820 of the memory 808 can be configured to perform a closed-loop optimization with the occupancy 914 and the planned ventilations 918 to determine ventilation times and/or ventilation amounts that result in optimal values for the indoor air quality 916. The result of the closed-loop optimization may be a set of ventilation actions, a timeseries of ventilation actions, i.e., the planned ventilations 918. The planned ventilations 918 optimized by the optimizer 820 can be provided to an energy-comfort cost model 904.

The energy-comfort cost model 904 can predict energy-comfort cost 924. The energy-comfort cost 924 can be a timeseries of values indicating energy savings and/or occupant comfort at one or more times during a time period, e.g., values at every hour of a day. The energy-comfort cost model 904 can predict the energy-comfort cost 924 based on the occupancy 914, the planned ventilations 918, outdoor conditions 920, and/or planned setpoint actions 922. The optimizer 820 can be configured to perform a closed-loop optimization to determine optimal planned setpoint actions 922, e.g., setpoint values for various times.

The results of the optimizations with the multi-tiered model 814 may be the planned ventilation actions 918 and the planned setpoint actions 922. The actions can be represented as:

$$\text{Ventilation Actions: } \{v_{(t+1)}, \ldots v_{(t+h)}\}$$

$$\text{Indoor Setpoint Actions: } \{S_{(t+1)}, \ldots S_{(t+h)}\}$$

In the optimizations performed by the optimizer 820 on the multi-tiered model 814 can prioritize the planned ventilations 918 and can be independently performed to optimize the indoor air quality 916 according to one or more IAQ goals.

The occupancy model 900 can be represented as $M_1$, the indoor air quality model 902 can be represented as $M_2$, while the energy-comfort cost model 904 can be represented as $M_3$. In some embodiments, the models $M_1$, $M_2$, and $M_3$ are built and/or execute in sequence. Models $M_1$, $M_2$, and $M_3$ are defined as follows:

$M_1$: predict occupancy conditioned on attendance system, time, day, meeting schedule, etc.

$M_2$: predict IAQ conditioned on predicted occupancy and planned vent action sequence $M_3$: predict energy and zone temperature conditioned on predicted occupancy, planned vent action sequence and planned setpoint sequence The optimizer 820 can be configured to perform a tiered optimization. The first tiered optimization may be for the indoor air quality 916:

$$O_{IAQ}\text{: optimize for } IAQ \text{ objective}$$

$$v^* = \arg_v \max(O_{IAQ}(q(v); M_1, M_2))$$

The optimizer 820 can be configured to perform a second optimization for the energy-comfort cost 924:

$O_{energy,comfort}$: optimize for energy objective,

-continued after $IAQ$ optimizing vent actions ($v$) are decided $$S^* = \arg_S \max(O_{energy,comfort}(e(S); z(s); M_1, M_3, v^*)$$

where $q$ indicate predicted IAQ and energy over horizon;

where $e$, $z$ indicate predicted energy and zone temperature over horizon;

where $v$, $s$ indicate ventilation actions and set−point actions planned for future In some embodiments, the model 904 can predict carbon emissions that results from the planned ventilations 918 and/or the planned setpoint actions 922. The model 904 can be optimized to reduce carbon emissions, e.g., identify planned setpoint actions 922 that meet one or more comfort constraints but also minimizes or reduce carbon emissions. The model 904 can, in some embodiments, include indications of the various power sources of the building, e.g., grid power from a coal, nuclear, or other power plant, battery storage, solar voltaic cells, water turbines, etc. and identify how much carbon would be produced at various times from consuming power from the various power sources. In this regard, when the model 904 is optimized, the optimization may result in more comfortable and less energy efficient settings if the power needed for the settings can be consumed from sources that do not produce large amounts of carbon, e.g., solar voltaic cells. However, the optimization may choose less comfortable and more energy efficient settings if the power needs to be consumed from a source that produces a large amount of carbon, e.g., a coal power plant. The model 904 may, in some embodiments, consider a marginal cost of carbon when identifying the planned setpoint actions 922. Examples of systems that optimize and manage carbon emissions are shown and described in U.S. patent application Ser. No. 17/483,078 filed September 23$^{rd}$, 2021 and U.S. Patent Application No. 63/246,177 filed September 20 $^{th}$, 2021, the entireties of which are incorporated by reference herein.

Figure 10:
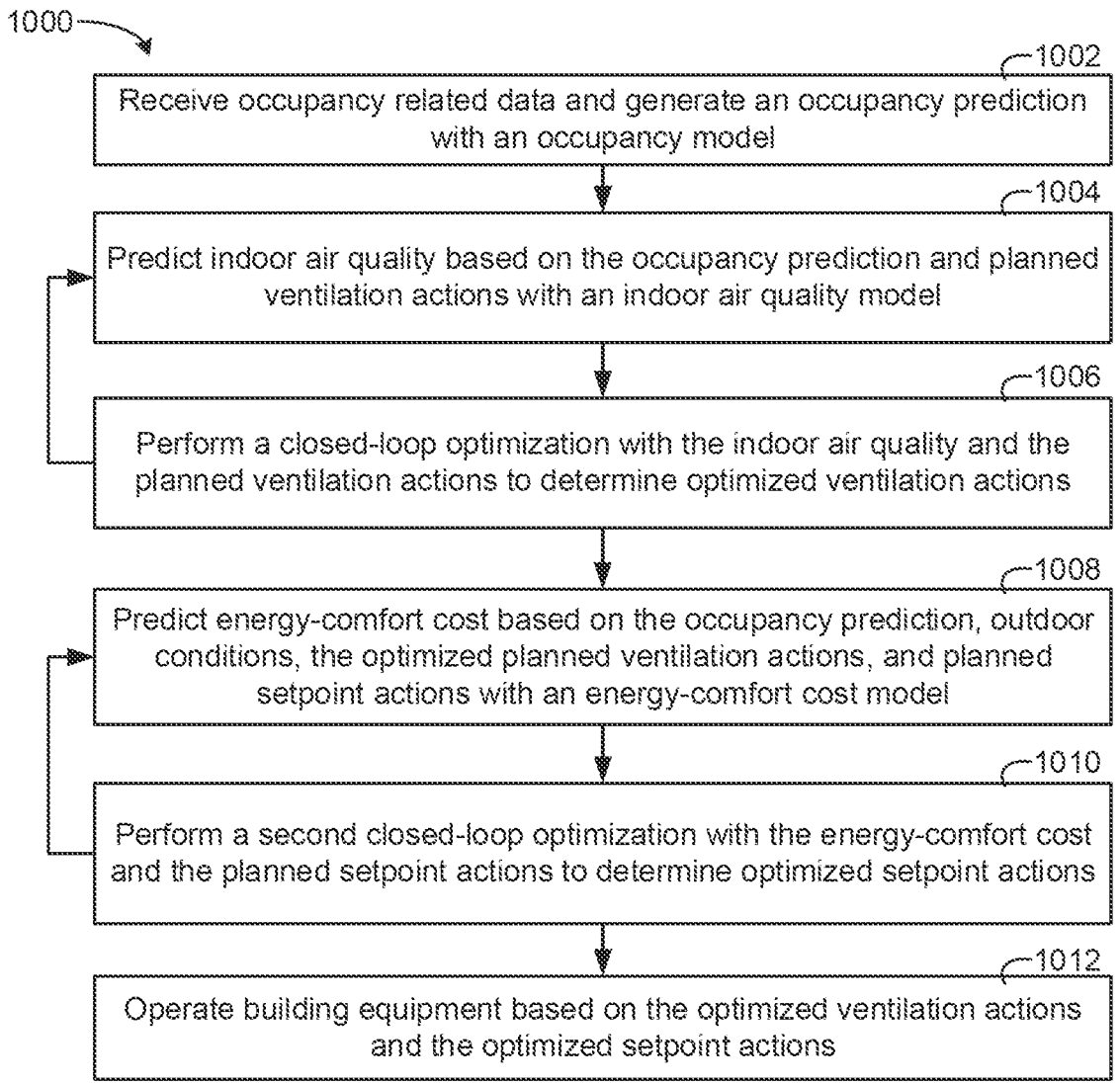
FIG. 10 is a flow diagram of a process for optimizing control decisions with the multi-tiered model to determine setpoints and ventilation actions, according to an exemplary embodiment.

Referring now to FIG. 10, a flow diagram of a process 1000 for optimizing control decisions with the multi-tiered model 814 to determine setpoints and ventilation actions is shown, according to an exemplary embodiment. In some embodiments, the multi-tiered prediction system 802 is configured to perform some or all of the process 1000. Any computing system or device described herein can be configured to perform the process 1000. In some embodiments, the process 1000 can be performed locally within the building on a controller or server of the building 10 (e.g., on-premises) or in a cloud system (e.g., off premises on a server system.).

In step 1002, the multi-tiered prediction system 802 receives occupancy related data and generates an occupancy prediction with the occupancy model 900 of the multi-tiered model 814. The occupancy related data can be data indicative of occupancy in a building, e.g., the data time of day 906, the day of week 908, the holiday schedule 910, and/or the meeting schedule 912 for the building 10.

In step 1004, the multi-tiered prediction system 802 can predict the indoor air quality 916 based on the occupancy prediction of the step 1002, the occupancy 914, and planned ventilation actions. The multi-tiered prediction system 802 can be configured to perform a closed-loop optimization with the indoor air quality model 902 to determine an optimal timeseries of ventilation actions that result in optimal indoor air quality.

In step 1008, the multi-tiered prediction system 802 predicts energy-comfort cost based on the occupancy prediction of the step 1004, outdoor conditions, the optimized planned ventilation actions of the step 1006, and planned setpoint actions with the energy-comfort cost model 904. In step 1010, the multi-tiered prediction system 802 performs a second closed-loop optimization with the energy-comfort cost and the planned setpoint actions to determine optimized setpoint actions. The optimized setpoint actions may be the planned setpoint actions 922. Based on the optimized ventilation actions of the step 1006 and the optimized setpoint actions of the step 1010, in step 1012, the multi-tiered prediction system 802 can operate the building systems 824, e.g., operate building equipment with the settings.

Figure 11:
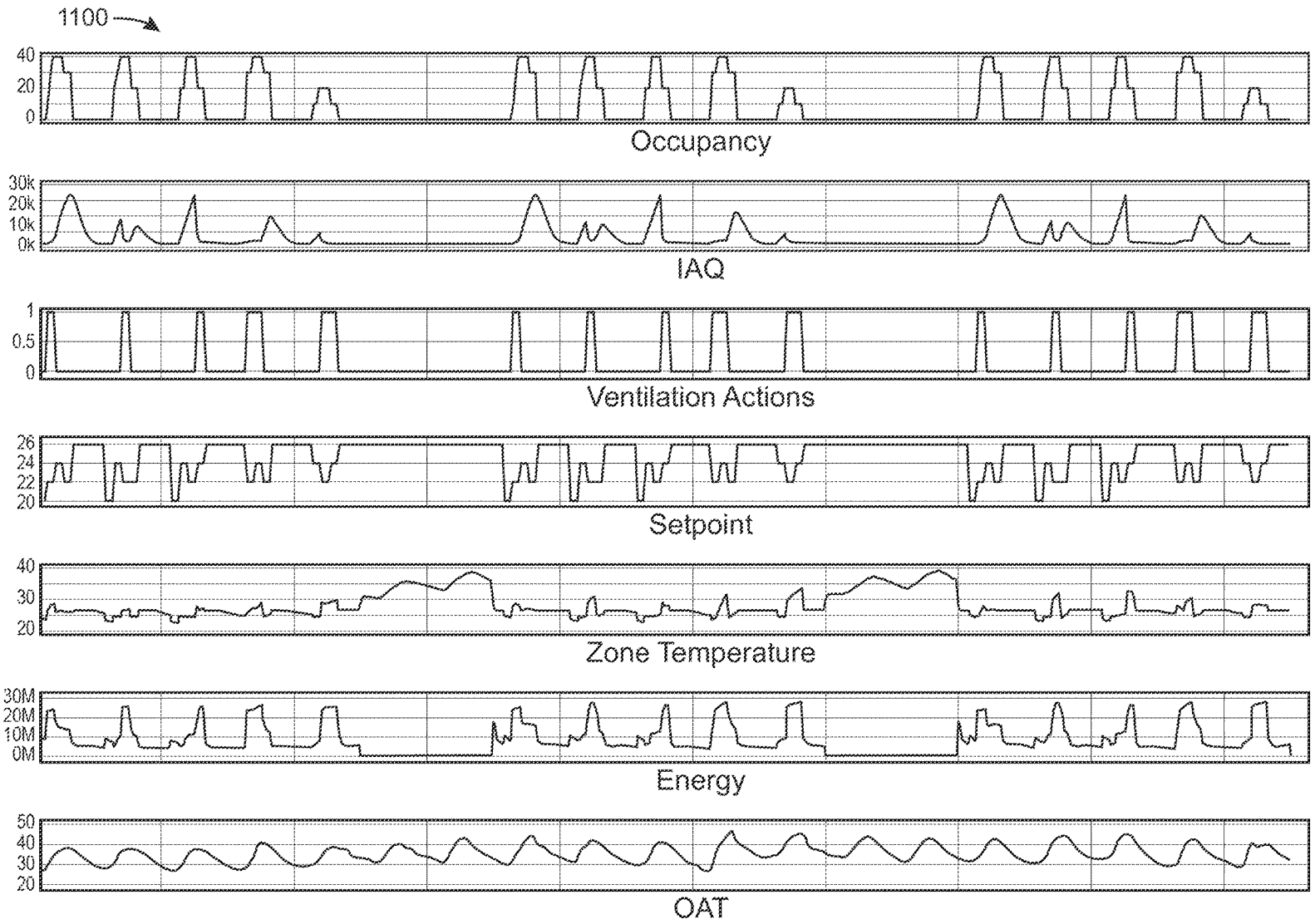
FIG. 11 is a chart illustrating occupancy, IAQ, ventilation actions, setpoints, zone temperature, energy usage, and outdoor air temperature for an optimization with the multi-tiered model, according to an exemplary embodiment.

Referring now to FIG. 11, a chart 1100 illustrating occupancy, IAQ, ventilation actions, setpoints, zone temperature, energy usage, and outdoor air temperature for an optimization with the multi-tiered model 814 is shown, according to an exemplary embodiment. The data of the chart 1100 can be timeseries data used to make predictions with the multi-tiered model 814 and/or timeseries predictions made with the multi-tiered model 814. The timeseries data can be data samples for every hour (or minute, half hour, etc.) of a day. In the chart 1100, the timeseries data is shown to span multiple days. In some embodiments, the multi-tiered prediction system 802 can run one or multiple optimizations with the multi-tiered model 814 to generate predictions over the multiple days.

Figure 12:
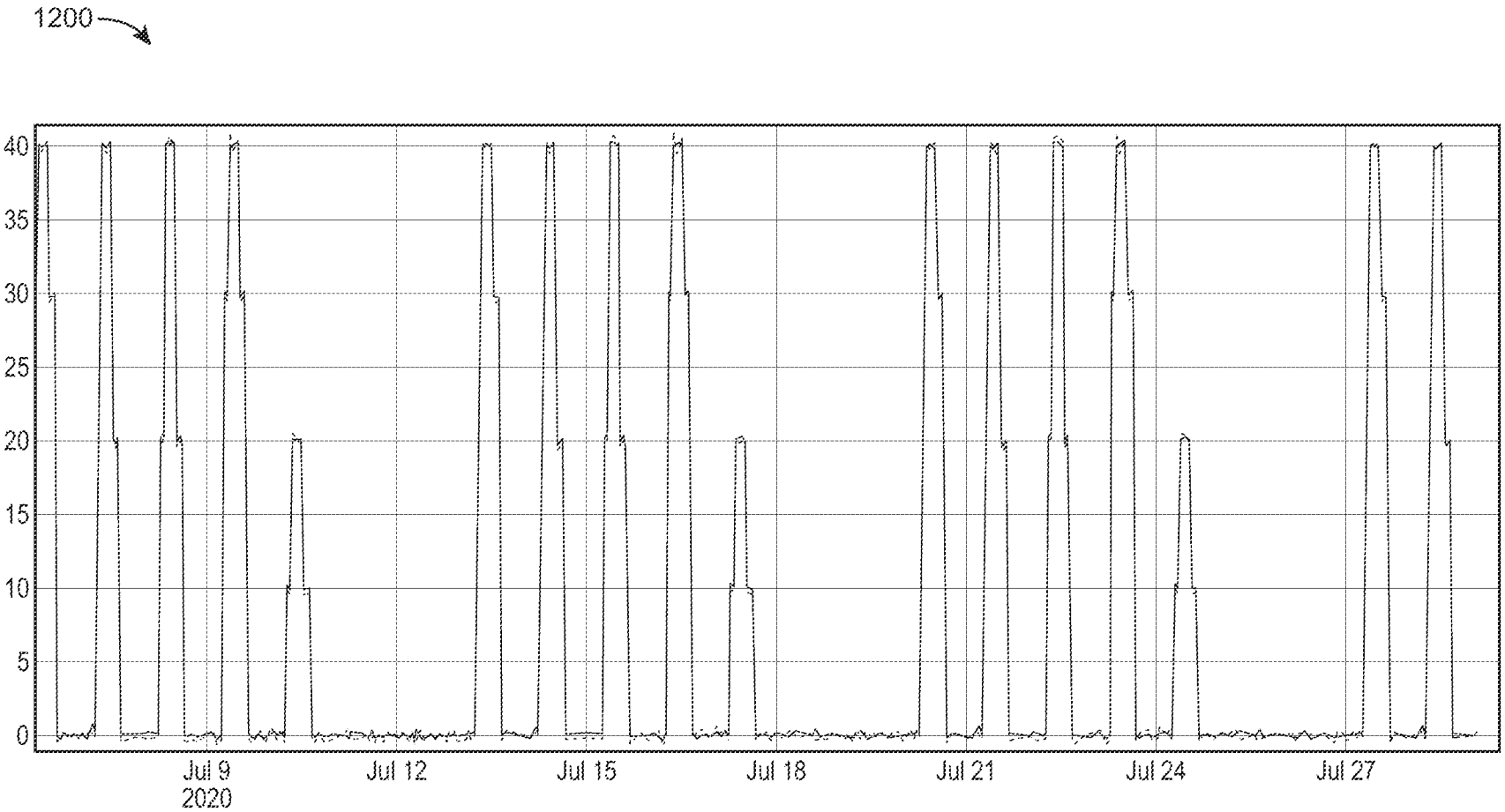
FIG. 12 is a chart illustrating occupancy predictions of the multi-tiered model, according to an exemplary embodiment.

Referring now to FIG. 12, a chart 1200 illustrating occupancy predictions of the multi-tiered model 814 is shown, according to an exemplary embodiment. The chart 1200 can indicate the occupancy prediction training of the occupancy model 900 of the multi-tiered model 814. The chart 1200 indicates a timeseries of training occupancy data used to train the occupancy model 900 and the resulting occupancy predictions of the occupancy model 900. The y-axis may be number of occupants while the x-axis may be time. FIG. 12 indicates three separate training/testing scenarios with dot-dashed lines, dashed lines, and solid lines respectively.

Figure 13:
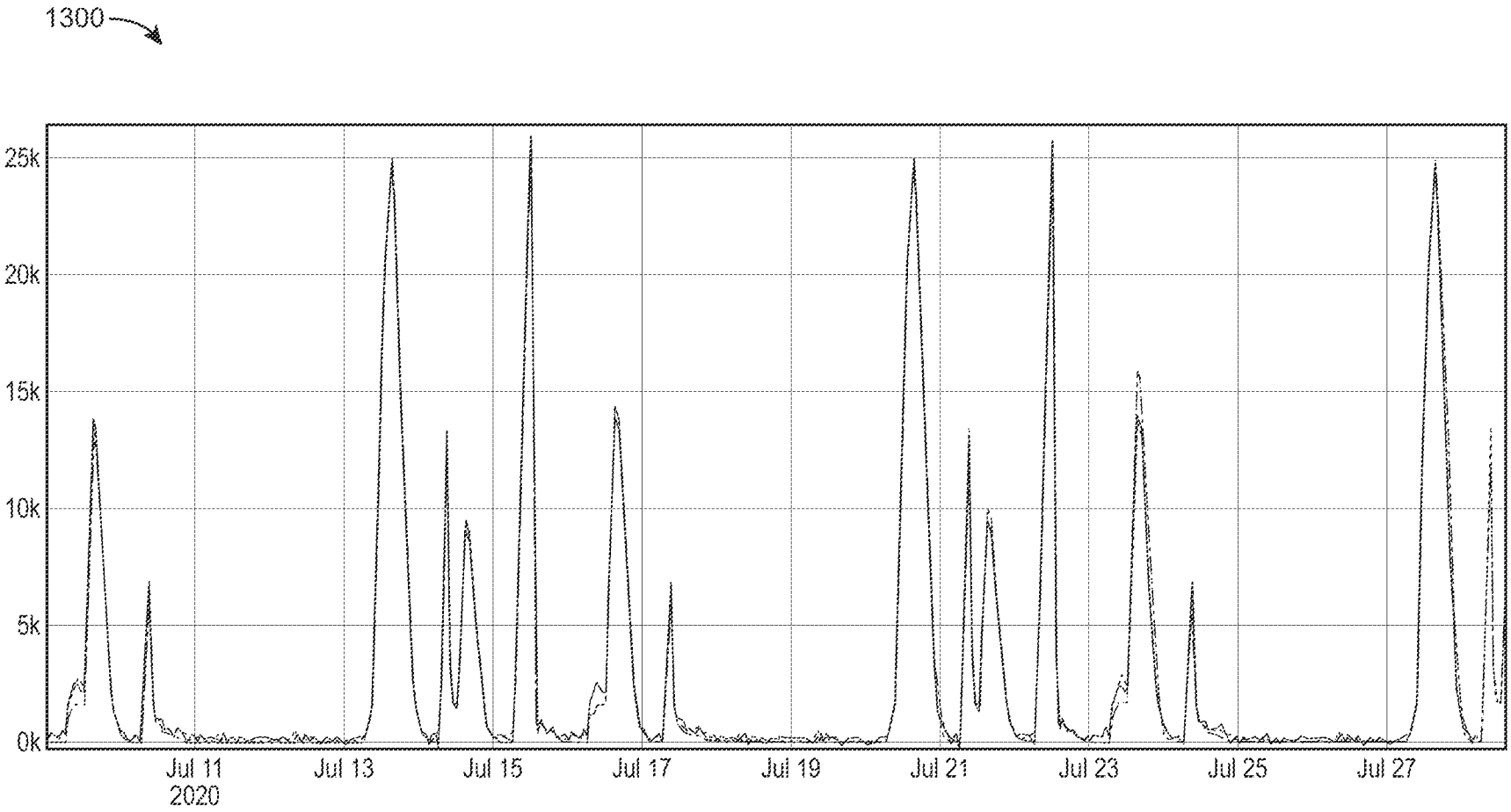
FIG. 13 is a chart illustrating IAQ predictions of the multi-tiered model, according to an exemplary embodiment.

Referring now to FIG. 13, a chart 1300 illustrating IAQ predictions of the multi-tiered model 814 is shown, according to an exemplary embodiment. The chart 1300 can indicate the IAQ training of the indoor air quality model 902 of the multi-tiered model 814. For example, the chart 1300 indicates a timeseries of training IAQ data used to train the indoor air quality model 902 and the resulting IAQ predictions of the indoor air quality model 902 are shown in FIG. 13. The y-axis may be number of air quality (e.g., PPM, PM10, PM2.5, VOC, CO2, etc.) while the x-axis may be time. FIG. 13 indicates three separate training/testing scenarios with dot-dashed lines, dashed lines, and solid lines respectively.

Figure 14:
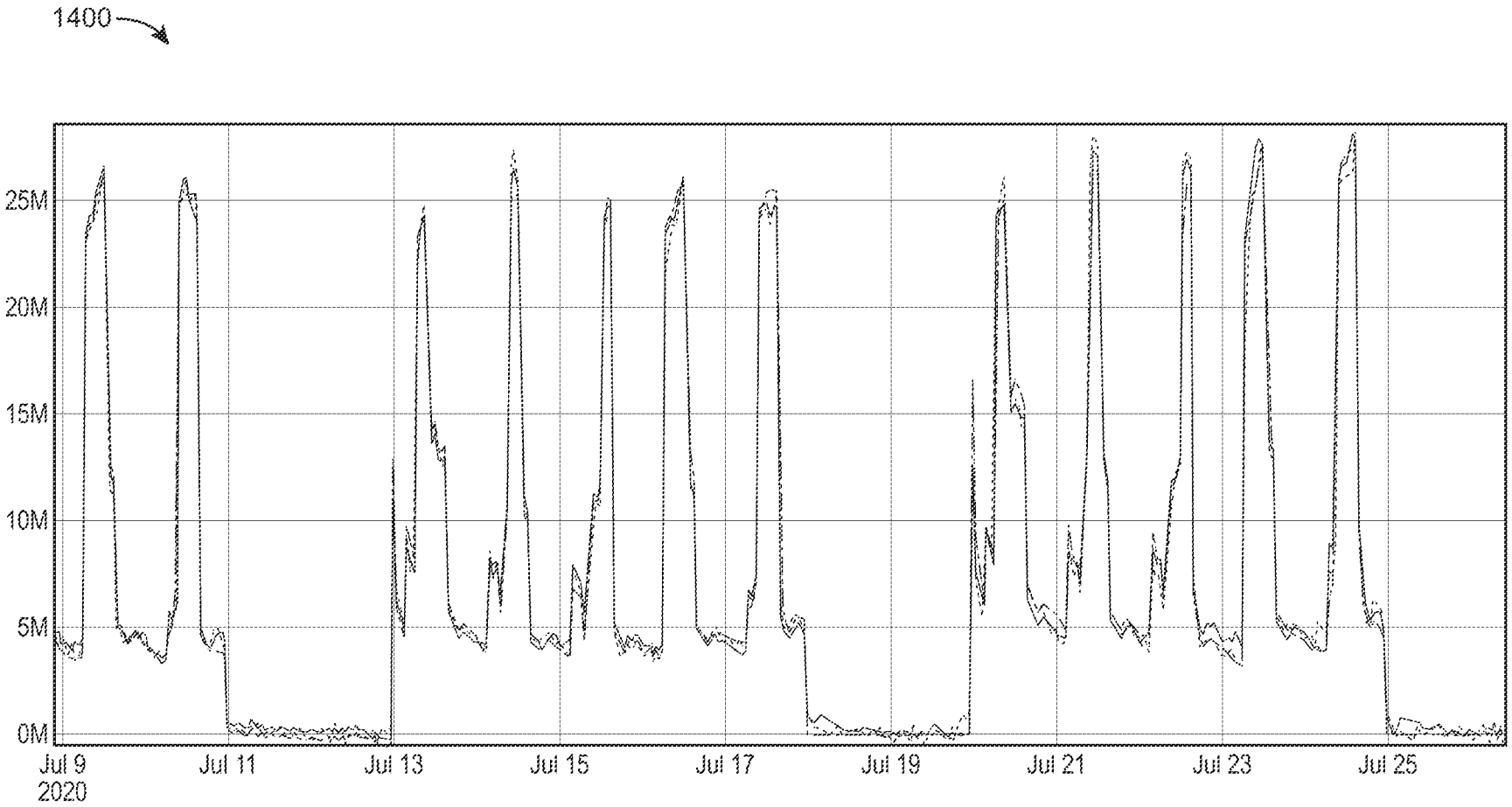
FIG. 14 is a chart illustrating energy and zone temperature predictions of the multi-tiered model, according to an exemplary embodiment.

Referring now to FIG. 14, a chart 1400 illustrating energy and zone temperature predictions of the multi-tiered model 814 is shown, according to an exemplary embodiment. The chart 1400 can indicates the energy and zone temperature predictions for training of the energy-comfort cost model 904 of the multi-tiered model 814, i.e., a timeseries of training data used to train the energy-comfort cost model 904 and the resulting predictions of the energy-comfort cost model 904 are shown in FIG. 14. The y-axis may be energy consumption in MWh, kWh BTUs, etc. while the x-axis may be time. FIG. 14 indicates three separate training/testing scenarios with dot-dashed lines, dashed lines, and solid lines respectively.

Figure 15:
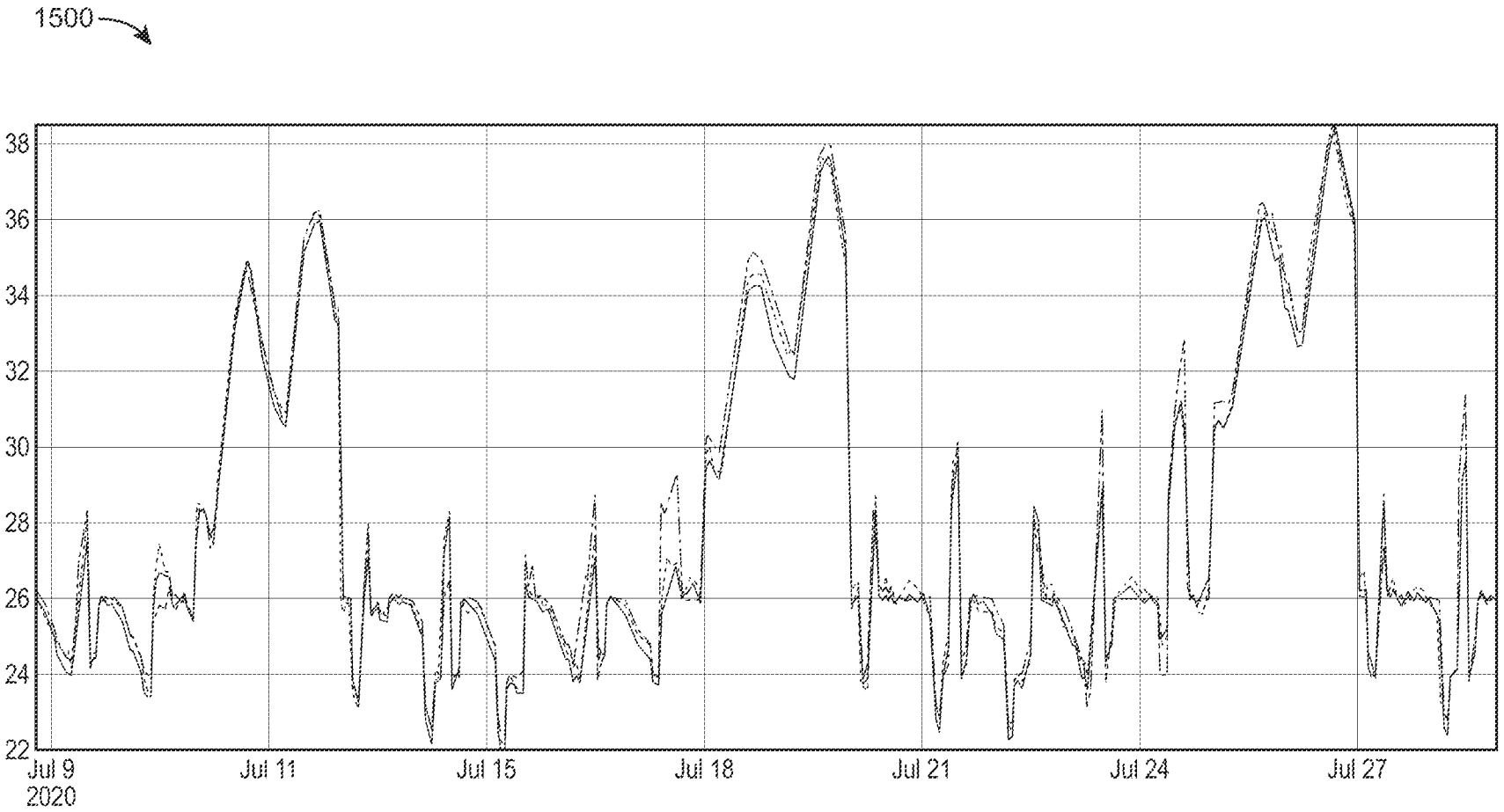
FIG. 15 is a chart illustrating zone temperature resulting from the optimization of the multi-tiered prediction system, according to an exemplary embodiment.

Referring now to FIG. 15, a chart 1500 illustrating zone temperature resulting from the optimization of the multi-tiered prediction system 802 is shown, according to an exemplary embodiment. The chart 1500 can indicates the zone temperature predictions for training of the multi-tiered model 814. The chart 1500 indicates a timeseries of training data used to train the multi-tiered model 814 and the resulting predictions of the multi-tiered model 814. The y-axis may be temperature in Celsius, Fahrenheit, etc. while the x-axis may be time. FIG. 15 indicates three separate training/testing scenarios with dot-dashed lines, dashed lines, and solid lines respectively.

Figure 16:
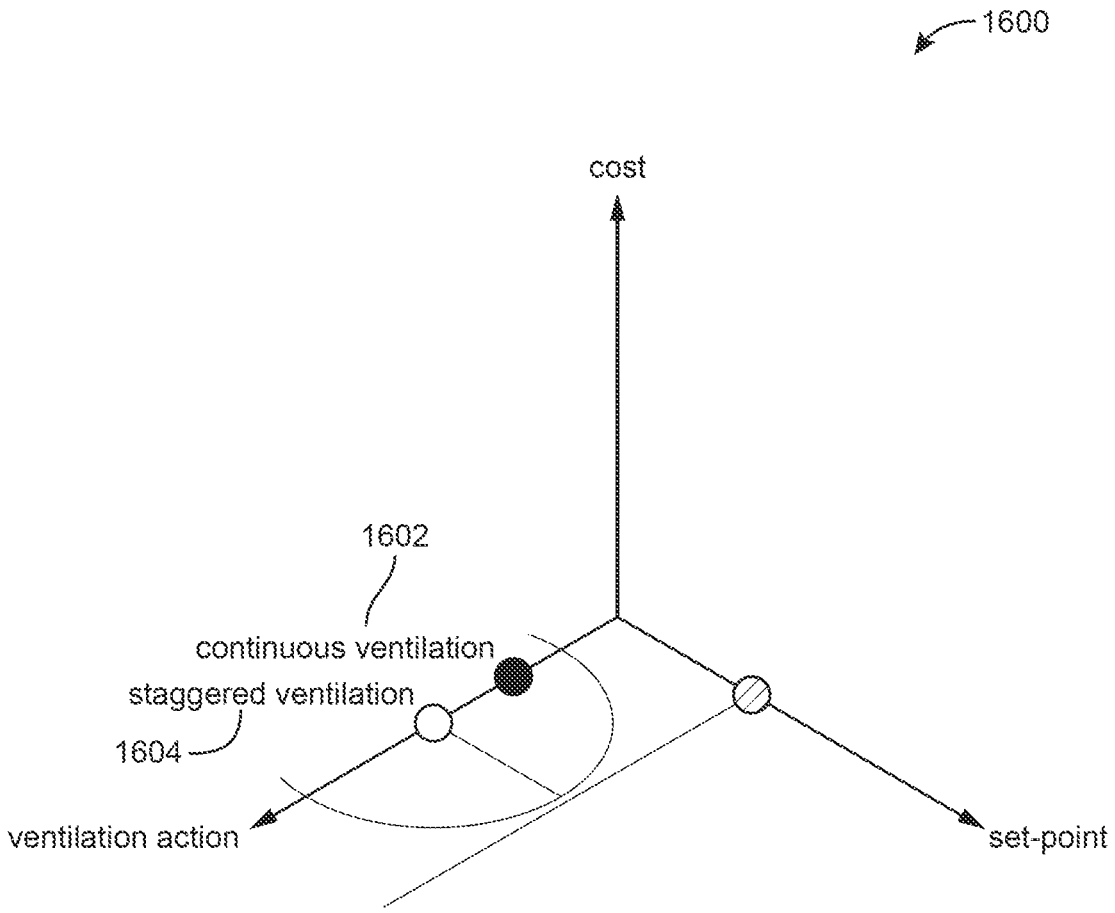
FIG. 16 is a chart illustrating an optimization of the multi-tiered prediction system resulting in staggered or continuous ventilation, according to an exemplary embodiment.

Referring now to FIG. 16, a chart 1600 illustrating an optimization of the multi-tiered prediction system 802 resulting in staggered or continuous ventilation is shown, according to an exemplary embodiment. In one scenario, scenario 1602, the multi-tiered prediction system 802 can generate an occupancy prediction for a twenty four hour period. Based on the occupancy prediction, the multi-tiered prediction system 802 can perform an optimization to determine ventilation between 10 A.M and 1 P.M. of the twenty four hour period. Based on the determined continuous ventilation, the multi-tiered prediction system 802 can determine optimal setpoints to be the highest allowed setpoints.

In another scenario, scenario 1604, the multi-tiered prediction system 802 can generate an occupancy prediction for a twenty four hour period with the multi-tiered model 814. The multi-tiered prediction system 802 can determine ventilation for particular times, e.g., staggered ventilation. The ventilation can be determined for particular times instead of a continuous time period, e.g., ventilation at 10 A.M., 12 P.M., and 2 P.M., for the twenty four hour period. Furthermore, the multi-tiered prediction system 802 can determine the highest allowed setpoints. In both scenarios 1602-1604, both ventilation can be optimized with the setpoint held constant or not considered.

Figure 17:
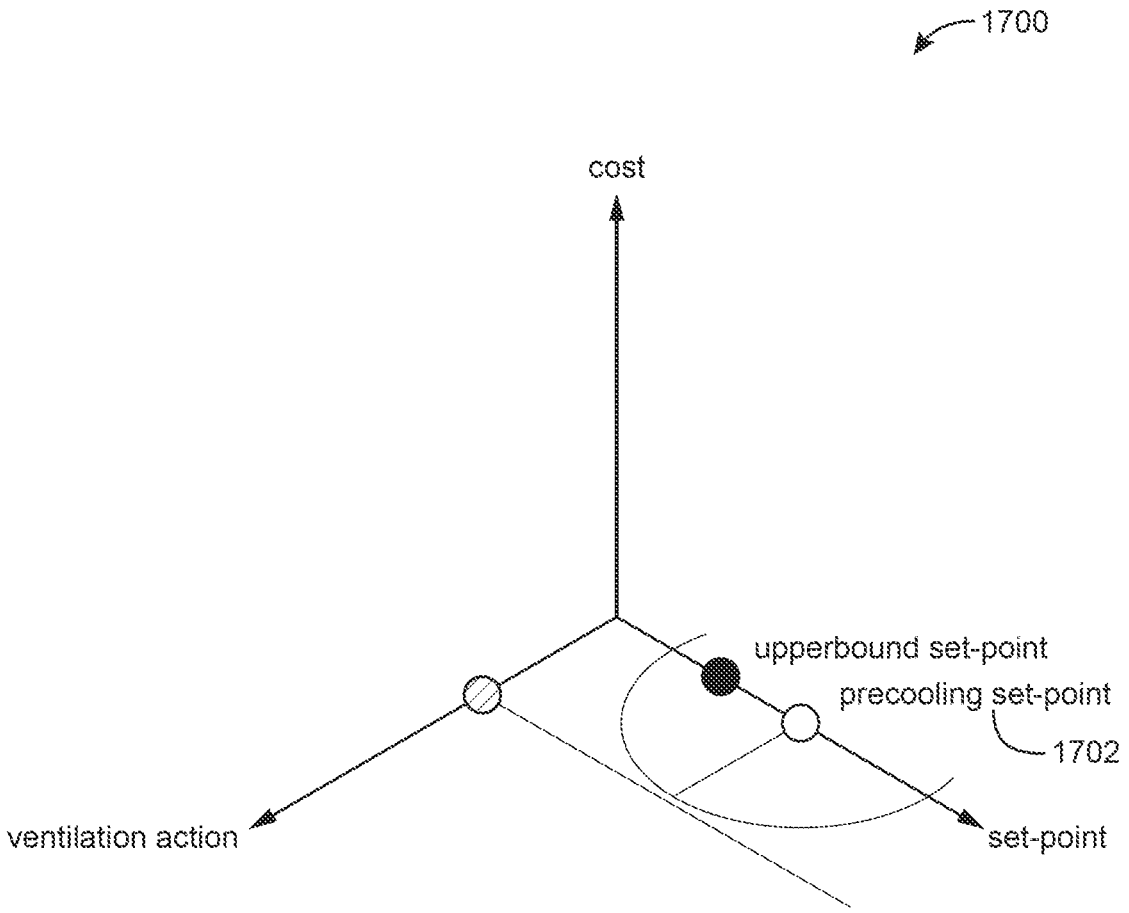
FIG. 17 is a chart illustrating an optimization of a multi-tiered prediction system resulting in upper bound setpoint and a precooling setpoint, according to an exemplary embodiment.

Referring now to FIG. 17, a chart 1700 illustrating an optimization of the multi-tiered prediction system 802 resulting in upper bound setpoint and a precooling setpoint is shown, according to an exemplary embodiment. In FIG. 16, the multi-tiered prediction system 802 can perform an optimization to determine ventilation actions without considering setpoint. Once the ventilation actions are determined, the multi-tiered prediction system 802 can determine optimal setpoints, e.g., as shown in FIG. 17.

In one scenario, scenario 1702, the multi-tiered prediction system 802 can determine an occupancy prediction for a twenty four hour period. Based on the occupancy prediction, the multi-tiered prediction system 802 can determine ventilation, for example, ventilation between 10 A.M. and 1 P.M. during the twenty four hour period. Based on the ventilation decisions, the multi-tiered prediction system 802 can determine precooling setpoints between 4 A.M. and 7 A.M. during the twenty four hour period.

Figure 18:
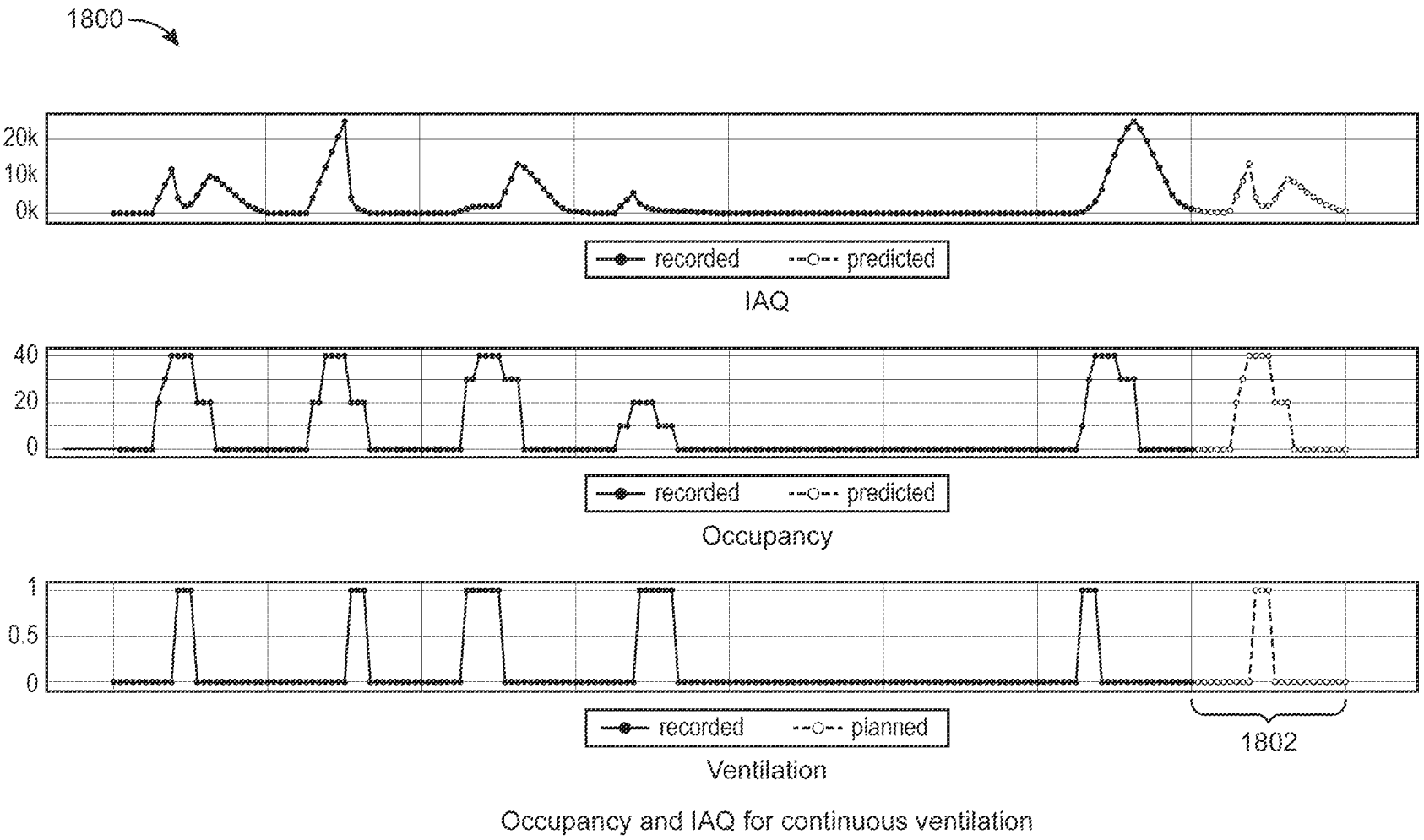
FIG. 18 is a chart indicating occupancy and IAQ for a scenario with continuous ventilation actions, according to an exemplary embodiment.
Figure 19:
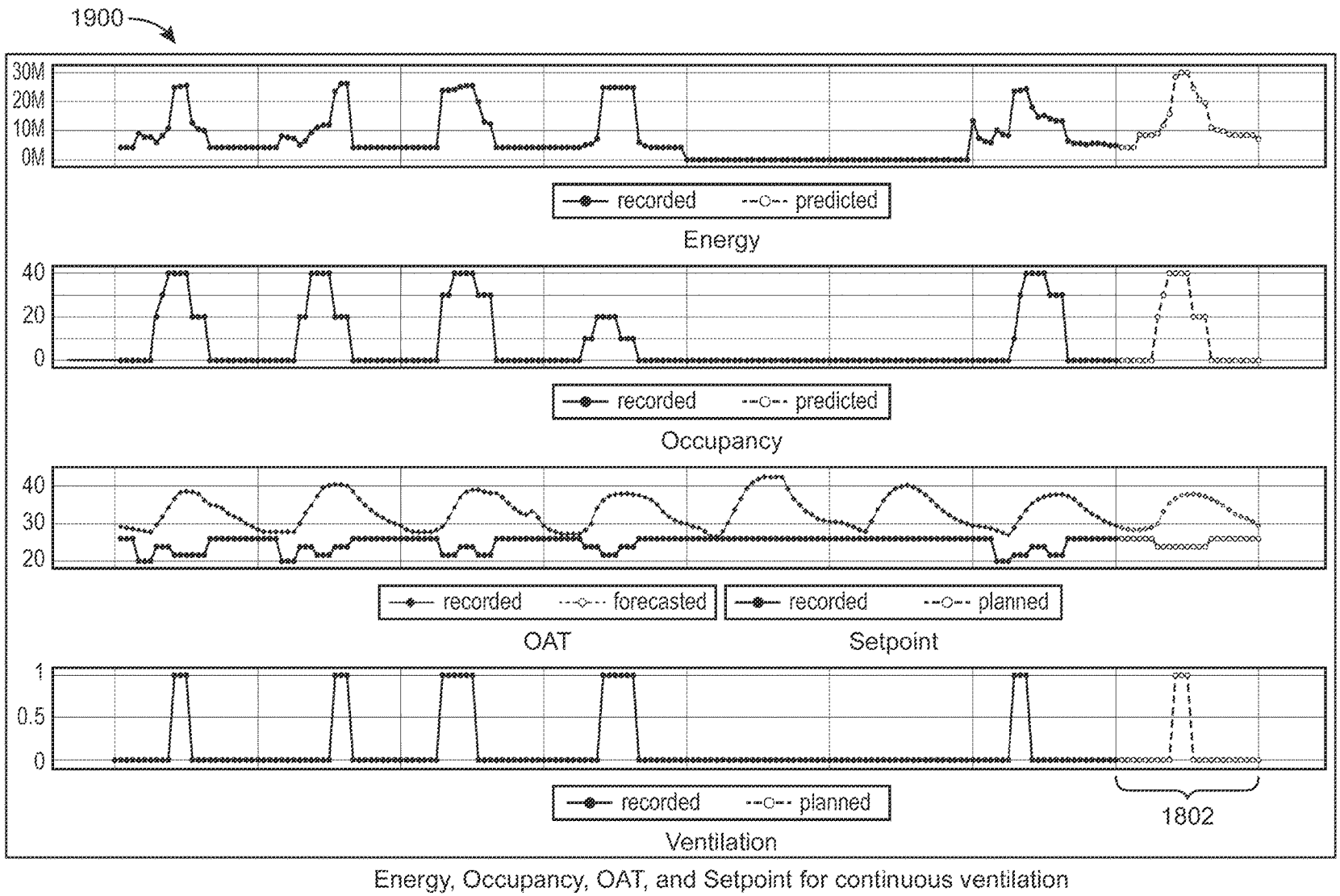
FIG. 19 is a chart indicating energy, occupancy, OAT, and setpoint actions for a scenario with continuous ventilation actions, according to an exemplary embodiment.

Referring now to FIG. 18, a chart 1800 indicating occupancy and IAQ for a continuous ventilation actions scenario for a time period 1802 is shown, according to an exemplary embodiment. The chart 1800 indicates occupancy and IAQ for the scenario 1602 of FIG. 16. Referring now to FIG. 19, a chart 1900 indicating energy, occupancy, OAT, and setpoint actions for a continuous ventilation actions scenario for the time period 1802 is shown, according to an exemplary embodiment. The chart 1900 indicates energy consumption for the scenario 1602 of FIG. 16.

Figure 20:
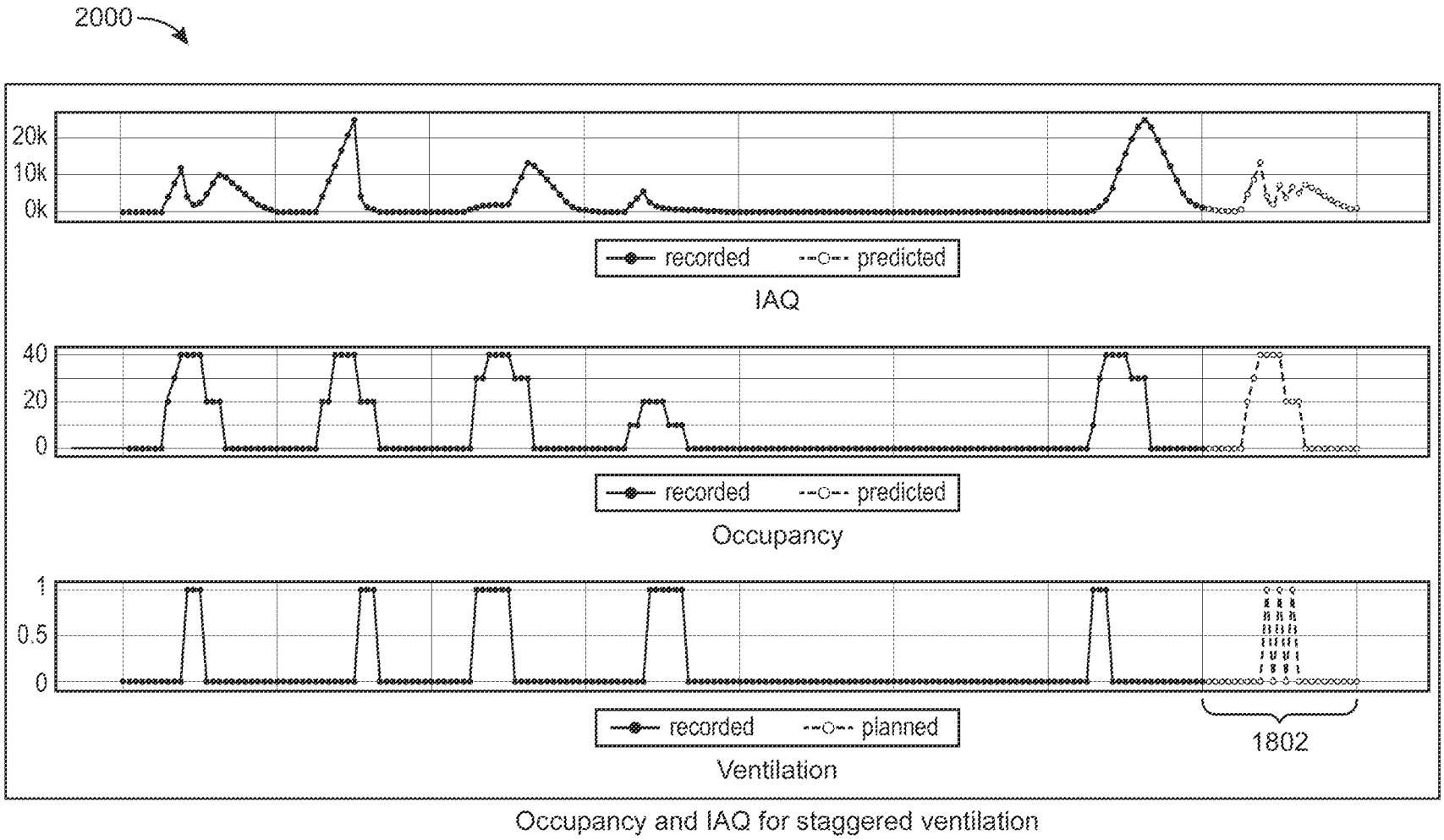
FIG. 20 is a chart indicating IAQ and occupancy for a scenario with staggered ventilation actions, according to an exemplary embodiment.

Referring now to FIG. 20, is a chart indicating IAQ and occupancy for a staggered ventilation actions scenario for the time period 1802 is shown, according to an exemplary embodiment. The chart 2000 indicates occupancy and IAQ for the scenario 1604 of FIG. 16. As can be seen, by comparing the chart 2000 with the chart 1800, the IAQ improves for the scenario 1604 when ventilation is staggered over time.

Figure 21:
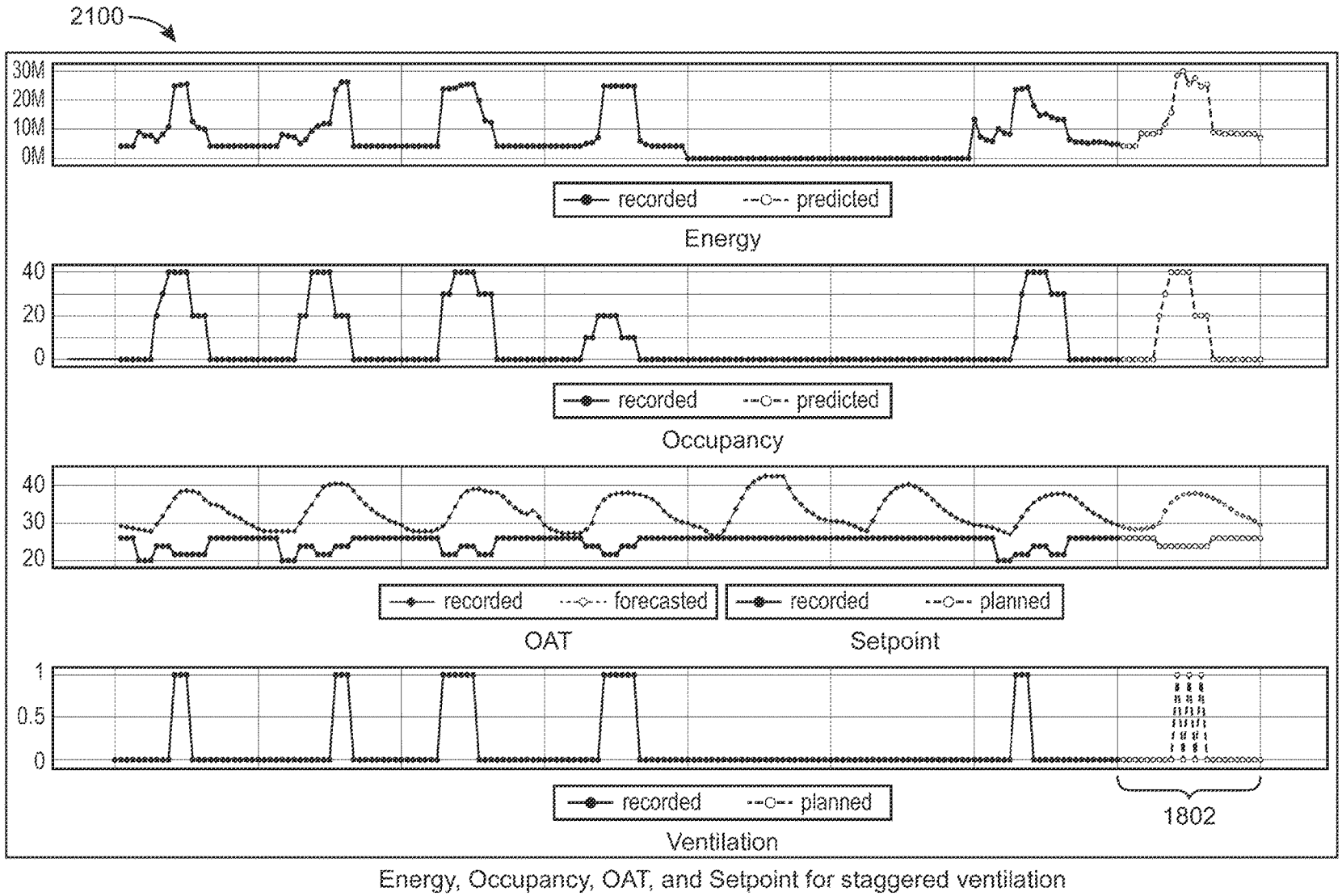
FIG. 21 is a chart indicating energy, occupancy, OAT, and setpoint actions for a scenario with staggered ventilation actions, according to an exemplary embodiment.

Referring now to FIG. 21, a chart 2100 indicating energy, occupancy, OAT, and setpoint actions for a staggered ventilation actions scenario for the time period 1802 is shown, according to an exemplary embodiment. The chart 2100 indicates energy consumption for the scenario 1604 of FIG. 16. By comparing the chart 2100 with the chart 1900, it can be seen that staggering ventilation uses more energy than constant ventilation but that the difference is minor. Therefore, the staggered ventilation results in improved IAQ with minor increases to energy usage.

Figure 22:
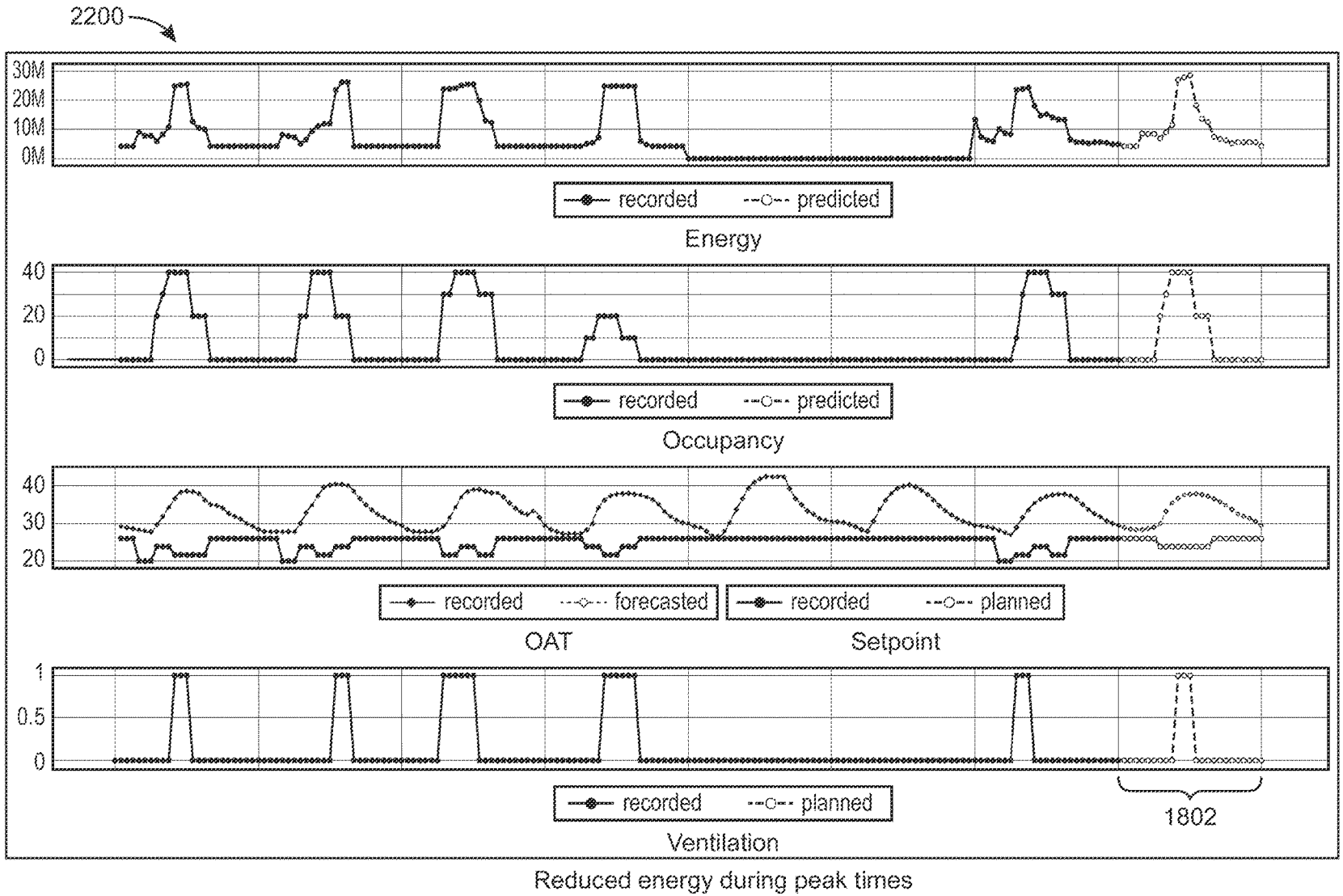
FIG. 22 is a chart indicating energy, occupancy, OAT, and ventilation actions for a scenario with pre-cooling setpoints, according to an exemplary embodiment.

Referring now to FIG. 22, a chart 2200 indicating energy, occupancy, OAT, and ventilation actions for a pre-cooling setpoints scenario for the time period 1802 is shown, according to an exemplary embodiment. The chart 2200 illustrates the pre-cooling setpoint scenario 1702 of FIG. 17. The chart 2200 illustrates energy usage when pre-cooling is used, i.e., a building is cooled before the building is occupied. Pre-cooling can result in energy savings. By comparing the chart 1900 and 2200, it can be seen that a significant amount of energy is saved when a building is pre-cooled.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A building system comprising one or more memory devices storing instructions thereon that, when executed by one or more processors, cause the one or more processors to:

receive building data for a building describing one or more conditions of the building;

perform a first optimization with a multi-tiered model that predicts air quality of the building based on a first control setting, the first optimization determining one or more first values of the first control setting to optimize the air quality;

perform a second optimization with the multi-tiered model that predicts energy consumption or comfort level of the building based on a second control setting and the one or more first values of the first control setting while holding the one or more first values of the first control setting constant to prioritize the air quality over the energy consumption or the comfort level, the second optimization determining one or more second values of the second control setting; and operate building equipment based on the one or more first values of the first control setting and the one or more second values of the second control setting.

2. The building system of claim 1, wherein the first control setting includes ventilation actions and the second control setting includes temperature setpoint actions.

3. The building system of claim 1, wherein the first optimization optimizes the first control setting without consideration of the second control setting.

4. The building system of claim 1, wherein optimizing the air quality and optimizing the energy consumption or the comfort level are inversely proportional.

5. The building system of claim 1, wherein the first optimization is performed before, and separate from, the second optimization to prioritize the air quality over the energy consumption or the comfort level.

6. The building system of claim 1, wherein the first optimization is a first closed-loop optimization and the second optimization is a second closed-loop optimization.

7. The building system of claim 1, wherein the multi-tiered model comprises a plurality of models comprising a first model and a second model;

wherein the first model receives at least some of the building data and the first control setting as first inputs and predicts the air quality of the building based on the first inputs;

wherein the first optimization determines the one or more first values of the first control setting that result in optimal predictions of the air quality of the building by the first model;

wherein the second model receives at least some of the building data, the first control setting, and the second control setting as second inputs and predicts the energy consumption or comfort level of the building based on the second inputs;

wherein the second optimization determines the one or more second values of the second control setting that result in optimal predictions of the energy consumption or comfort level of the building by the second model.

8. The building system of claim 1, wherein the multi-tiered model comprises a plurality of models comprising a first model that predicts the air quality of the building and a second model that predicts the energy consumption or comfort level of the building.

9. The building system of claim 8, wherein the first model and the second model are sequence to sequence neural networks configured to receive a sequence of data inputs and predict a sequence of data outputs based on the sequence of data inputs, wherein the sequence of data inputs are the building data and the sequence of data outputs are one of the first control setting or the second control setting.

10. The building system of claim 9, wherein the sequence to sequence neural networks are long-short term memory (LSTM) sequence to sequence neural networks.

11. The building system of claim 1, wherein the multi-tiered model includes:

an occupancy model configured to predict occupancy of the building;

an indoor air quality (IAQ) model configured to predict the IAQ air quality of the building based on the occupancy of the building predicted by the occupancy model and planned ventilations; and an energy model configured to predict the energy consumption or comfort level of the building based on the occupancy of the building predicted by the occupancy model and the planned ventilations.

12. The building system of claim 11, wherein the occupancy model receives at least one of a time of day, a day of week, a holiday schedule, or a meeting schedule and predicts the occupancy of the building based on at least one of the time of day, the day of week, the holiday schedule, or the meeting schedule.

13. The building system of claim 11, wherein the energy model is configured to predict the energy consumption of the building based on the occupancy of the building predicted by the occupancy model, the planned ventilations, outdoor conditions of the building, and planned setpoint actions of the building.

14. A method comprising:

receiving, by a processing circuit, building data for a building describing one or more conditions of the building;

performing, by the processing circuit, a first optimization with a multi-tiered model that predicts air quality of the building based on a first control setting, the first optimization determining one or more first values of the first control setting to optimize the air quality;

performing, by the processing circuit, a second optimization with the multi-tiered model that predicts energy consumption or comfort level of the building based on a second control setting and the one or more first values of the first control setting while holding the one or more first values of the first control setting constant to prioritize the air quality over the energy consumption or the comfort level, the second optimization determining one or more second values of the second control setting; and operating, by the processing circuit, building equipment based on the one or more first values of the first control setting and the one or more second values of the second control setting.

15. The method of claim 14, wherein the first control setting includes ventilation actions and the second control setting includes temperature setpoint actions.

16. The method of claim 14, wherein the multi-tiered model comprises a plurality of models comprising a first model that predicts the air quality of the building and a second model that predicts the energy consumption or the comfort level of the building;

wherein the first model receives at least some of the building data and the first control setting as first inputs and predicts the air quality of the building based on the first inputs;

wherein the first optimization determines the one or more first values of the first control setting that result in optimal predictions of the air quality of the building by the first model;

wherein the second model receives at least some of the building data, the first control setting, and the second control setting as second inputs and predicts the energy consumption or the comfort level of the building based on the second inputs;

wherein the second optimization determines the one or more second values of the second control setting that result in optimal predictions of the energy consumption or the comfort level of the building by the second model.

17. The method of claim 16, wherein the multi-tiered model includes:

an occupancy model configured to predict occupancy of the building;

an indoor air quality (IAQ) model configured to predict IAQ of the building based on the occupancy of the building predicted by the occupancy model and planned ventilations; and an energy model configured to predict the energy consumption of the building based on the occupancy of the building predicted by the occupancy model and the planned ventilations.

18. A building system comprising one or more memory devices storing instructions thereon that, when executed by one or more processors, cause the one or more processors to:

receive building data for a building describing one or more conditions of the building;

determine one or more first values of a first control setting with a multi-tiered model that predicts air quality of the building based on the first control setting to optimize the air quality;

determine one or more second values of a second control setting with the multi-tiered model that predicts energy consumption or comfort level of the building based on the second control setting and the one or more first values of the first control setting while holding the one or more first values of the first control setting constant to prioritize the air quality over the energy consumption or the comfort level; and operate building equipment based on the one or more first values of the first control setting and the one or more second values of the second control setting.

19. The building system of claim 18, the first control setting includes ventilation actions and the second control setting includes temperature setpoint actions.

20. The building system of claim 18, wherein the first optimization optimizes the first control setting without consideration of the second control setting.

* * * * *